US009331384B2

(12) United States Patent
Jenwatanavet et al.

(10) Patent No.: US 9,331,384 B2
(45) Date of Patent: May 3, 2016

(54) BATTERY ANTENNA HAVING A SECONDARY RADIATOR

(75) Inventors: Jatupum Jenwatanavet, San Diego, CA (US); Allen M. Tran, San Diego, CA (US); Joe C. Le, San Diego, CA (US); Leif A. Woodahl, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 246 days.

(21) Appl. No.: 13/613,884

(22) Filed: Sep. 13, 2012

(65) Prior Publication Data

US 2014/0071004 A1 Mar. 13, 2014

(51) Int. Cl.

| | |
|---|---|
| ***H01Q 1/44*** | (2006.01) |
| ***H01Q 1/46*** | (2006.01) |
| *H01Q 5/378* | (2015.01) |

(52) U.S. Cl.

CPC . *H01Q 1/44* (2013.01); *H01Q 1/46* (2013.01); *H01Q 5/378* (2015.01)

(58) Field of Classification Search

CPC ..... H01Q 1/24; H01Q 1/38; H01Q 1/44
USPC ..... 343/700 MS, 702, 876, 720; 340/539.32, 572.4
See application file for complete search history.

(56) References Cited

U.S. PATENT DOCUMENTS

| | | | | |
|---|---|---|---|---|
| 4,920,353 | A | 4/1990 | Mori et al. | |
| 5,227,805 | A | 7/1993 | King et al. | |
| 6,671,494 | B1 * | 12/2003 | James | 455/66.1 |
| 7,202,825 | B2 * | 4/2007 | Leizerovich et al. | 343/702 |
| 7,394,382 | B2 * | 7/2008 | Nitzan et al. | 340/572.8 |
| 7,423,539 | B2 * | 9/2008 | Hyde et al. | 340/572.4 |
| 8,319,636 | B2 * | 11/2012 | Brommer et al. | 340/539.32 |
| 8,552,921 | B2 * | 10/2013 | Kato | 343/876 |
| 8,564,432 | B2 * | 10/2013 | Covannon et al. | 340/539.12 |
| 2003/0231106 | A1 | 12/2003 | Shafer | |
| 2010/0068995 | A1 | 3/2010 | Brantner | |
| 2010/0113111 | A1 | 5/2010 | Wong et al. | |
| 2012/0170624 | A1 | 7/2012 | Rozenblit et al. | |

FOREIGN PATENT DOCUMENTS

| | | | |
|---|---|---|---|
| DE | 19824145 | A1 | 12/1999 |
| EP | 0718908 | B1 | 10/2001 |
| EP | 1986135 | A1 | 10/2008 |
| GB | 2334624 | A | 8/1999 |
| WO | WO-03043101 | A2 | 5/2003 |

OTHER PUBLICATIONS

International Search Report and Written Opinion—PCT/US2013/059459—ISA/EPO—Nov. 28, 2013.

(Continued)

*Primary Examiner* — Huedung Mancuso
(74) *Attorney, Agent, or Firm* — Linda G. Gunderson

(57) ABSTRACT

A combination battery and antenna includes a battery having a positive contact and a negative contact, at least one of the positive contact and the negative contact comprising an antenna coupled to a matching circuit and to a radio frequency choke, whereby direct current (DC) is supplied to a battery circuit and a radio frequency (RF) signal is supplied to an RF circuit, and at least one secondary radiator parasitically coupled to the at least one of the positive contact and the negative contact of the battery.

19 Claims, 23 Drawing Sheets

(56) References Cited

OTHER PUBLICATIONS

Taiwanese Office Action Patent Application No. TW102133251; Mailing Date: Nov. 14, 2015.

Taiwanese Office Action Translation Patent Application No. TW102133251; Translation Dec. 18, 2015.

* cited by examiner

BATTERY ANTENNA HAVING A SECONDARY RADIATOR

DESCRIPTION OF THE RELATED ART

Electronic devices, such as portable communication devices, continue to shrink in size. All such portable communication devices also use some type of antenna for transmitting and receiving communication signals. While the physical size of the device is largely controlled by continually evolving design and manufacturing technology, which results in smaller and smaller devices, the performance of the antenna is directly proportional to the physical size of the antenna. Ideally, for optimum performance, the size of antenna should be close to one quarter of the wavelength of the resonant frequency of the received and transmitted signals in order to ensure sufficient radiated and received performance of the antenna. This antenna design goal limits the physical size of the antenna thereby establishing a compromise between antenna performance and the overall physical size of the device.

It would be desirable to have a communication device that exhibits good radio frequency (RF) performance, but which minimizes the overall size of the device and the antenna.

SUMMARY

An embodiment of a combination battery and antenna includes a battery having a positive contact and a negative contact, at least one of the positive contact and the negative contact comprising an antenna coupled to a matching circuit and to a radio frequency choke, whereby direct current (DC) is supplied to a battery circuit and a radio frequency (RF) signal is supplied to an RF circuit, and at least one secondary radiator parasitically coupled to the at least one of the positive contact and the negative contact of the battery.

BRIEF DESCRIPTION OF THE DRAWINGS

In the figures, like reference numerals refer to like parts throughout the various views unless otherwise indicated. For reference numerals with letter character designations such as "102*a*" or "102*b*", the letter character designations may differentiate two like parts or elements present in the same figure. Letter character designations for reference numerals may be omitted when it is intended that a reference numeral encompass all parts having the same reference numeral in all figures.

DETAILED DESCRIPTION

Figure 1:
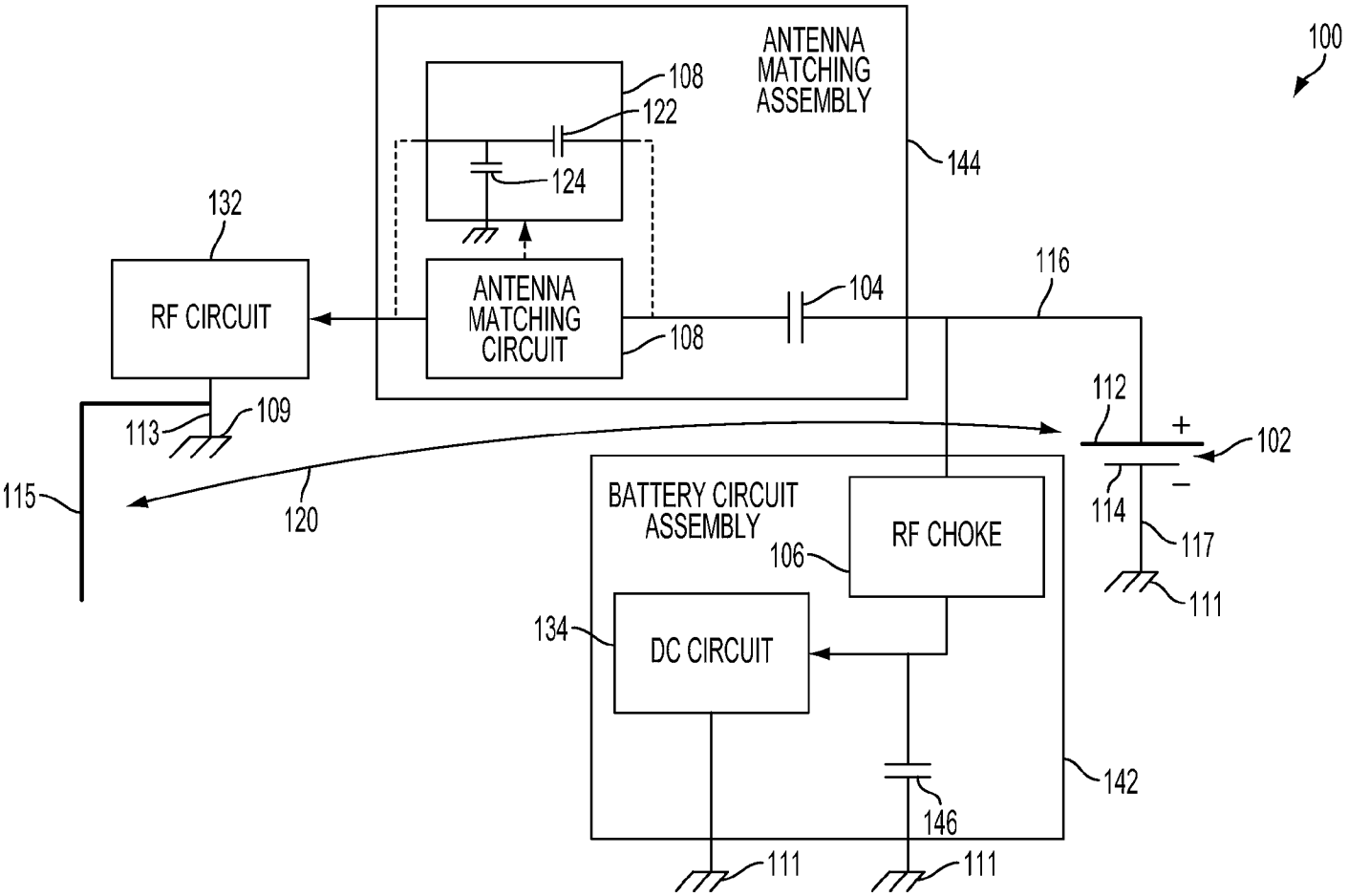
FIG. 1 shows a block diagram of a circuit having a combination battery antenna with a secondary radiator.

The word "exemplary" is used herein to mean "serving as an example, instance, or illustration." Any aspect described herein as "exemplary" is not necessarily to be construed as preferred or advantageous over other aspects.

In this description, the term "application" may also include files having executable content, such as: object code, scripts, byte code, markup language files, and patches. In addition, an "application" referred to herein, may also include files that are not executable in nature, such as documents that may need to be opened or other data files that need to be accessed.

The term "content" may also include files having executable content, such as: object code, scripts, byte code, markup language files, and patches. In addition, "content" referred to herein, may also include files that are not executable in nature, such as documents that may need to be opened or other data files that need to be accessed.

The terms "parasitic coupling" and "parasitically coupled" as used herein refer to a condition that acts to electromagnetically couple electrically conductive structures that are not in direct physical contact when an alternating current exists in at least one of the structures.

As used in this description, the terms "component," "database," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device may be a component. One or more components may reside within a process and/or thread of execution, and a component may be localized on one computer and/or distributed between two or more computers. In addition, these components may execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

The battery antenna having a secondary radiator can be implemented in any communication device that engages in either one way, or bi-directional radio frequency (RF) communication. The battery antenna having a secondary radiator can be implemented in communication devices that operate over a wide range of frequencies and communication bands. As an example, the battery antenna having a secondary radiator can be implemented in a communication device that operates over RF frequencies referred to as the "Bluetooth" communication band, RF frequencies identified by the IEEE 802.11b/g/n standard, in a communication device that operates over cellular communication frequencies, and can be implemented in communication devices that operate on any radio frequency.

As used herein, the terms "radiator" and "secondary radiator" refer to one or more antenna radiating elements or antenna receiving elements that can be parasitically coupled to a battery, at least one contact element of which is used as an antenna for a communications device.

FIG. 1 shows a block diagram of a circuit 100 having a combination battery antenna with a secondary radiator. The circuit 100 includes a battery 102 coupled to a capacitor 104 and to a radio frequency (RF) choke 106 over a conductor 116. An antenna matching circuit 108 is coupled to the capacitor 104. The battery 102 is used as the source of direct current (DC) energy and as the antenna for a communication device (not shown) having the circuit 100. The battery 102 typically comprises a two-part metallic case where one part of the metallic case forms the positive contact 112 of the battery 102 and the other part of the metallic case forms the negative contact 114 of the battery 102. The term "contact" refers to the metal material that forms the case of the battery 102. Other battery configurations are possible. In an embodiment, the metal material of the positive contact 112 of the battery 102 is used as an antenna radiating element and the metal of the negative contact 114 of the battery 102 is connected to a direct current (DC) ground 111 over a conductor 117. In an alternative embodiment, the metal material of the negative contact 114 of the battery 102 is used as an antenna radiating element and is also coupled to the DC ground 111 through an additional RF choke, which will be described in greater detail below.

In an embodiment of the battery antenna having a secondary radiator, a radiator element 115 is electrically coupled to the RF ground 109. In an embodiment, the radiator element 115 may also be coupled to the negative contact 114 of the battery 102. However, as will be described in greater detail below, the radiator element 115 need not be connected to the negative contact 114 of the battery 102, or to the RF ground 109. Further, it is possible to have more than one radiator element 115, where one or more radiator elements are coupled to the RF ground 109, or where one or more radiator elements are coupled to the RF ground 109 and/or where one or more radiator elements are isolated from the RF ground 109. The radiator element 115 is referred to herein as a secondary radiator because it improves the performance of the battery 102 when used as an antenna without being physically or mechanically connected to the positive contact 112 of the battery 102 or to the negative contact of the battery 102. In accordance with an embodiment of the battery antenna having a secondary radiator, the secondary radiator 115 is parasitically coupled to whichever battery contact is used as the antenna. In an embodiment, the secondary radiator 115 is parasitically coupled to the positive contact 112 of the battery 102 so as to improve the performance of the battery 102 as an antenna. This parasitic coupling is illustrated using reference numeral 120. As will be described in greater detail below, the secondary radiator 115 can be a metal or metallic structure that is mechanically coupled to the RF ground 109. Alternatively, the secondary radiator 115 can be a metal or metallic structure formed as a part of a ground plane of a circuit card assembly, PCB, PWB, or the like. The terms "metal" and "metallic" are intended to include any conductive metal or metal alloy material. Alternatively, the secondary radiator 115 need not be physically coupled, or otherwise mechanically attached, to the RF ground 109, or, in alternative embodiments, to the positive contact 112 of the battery 102 or the negative contact 114 of the battery 102. In such embodiments, the secondary radiator 115 can be a metal or metallic structure that is located in the vicinity of either the positive contact 112 or the negative contact 114 of the battery 102, such that parasitic coupling can occur between the secondary radiator 115 and any of the positive contact 112 or the negative contact 114 of the battery 102 without a physical connection between the structures.

Further still, in alternative embodiments, the RF ground 109 and the DC ground 111 are combined as a single ground.

The antenna matching circuit 108 can be constructed using any combination of capacitive and/or inductive components to form a circuit that ensures that the antenna formed by the positive contact 112 and the secondary radiator 115 radiates and receives RF energy at the desired radio frequency or frequencies.

A radio frequency (RF) circuit 132 is connected to the output of the antenna matching circuit 108. The RF circuit 132 is coupled to an RF ground 109. The RF ground 109 can be coupled to a circuit card assembly (CCA), a printed circuit board (PCB), a printed wiring board (PWB), or any other structure that includes an electrical ground for the RF portion of the circuit. In an embodiment, an RF portion of a communication device and a DC portion of the communication device can share the same ground.

The capacitor 104 is coupled in series between the positive contact 112 of the battery 102 and the antenna matching circuit 108 to block DC power produced by the battery 102 from entering the RF circuit 132. The capacitor 104 is selected so as to appear as a short circuit at the desired radio frequency or frequencies, but appear as an open circuit at DC. The antenna matching circuit 108 can include passive circuitry including, as an example, one or more capacitive (C) elements and/or one or more inductive (L) elements. The capacitive and inductive elements can be arranged in a network structure that is optimized for the particular range of frequencies sought to be transmitted and received. As an example in the 2.4 GHz-2.5 GHz frequency range, used by so-called "Bluetooth" communication devices, a typical matching circuit might include capacitive elements 122 and 124 arranged in a circuit as shown. The capacitive elements 122 and 124 are shown as connected to the connection 116 using a dotted line to illustrate that these are example values only. An example value for the capacitive element 122 is 1.8 pF and an example value for the capacitive element 124 is 0.5 pF. Other values and elements, including inductive elements can be implemented depending on the desired operating frequency and the size and configuration of the circuit card assembly (CCA), printed circuit board (PCB), or printed wiring board (PWB) associated with the battery antenna having a secondary radiator. In an alternative implementation, the capacitor 122 can also function as a DC blocking capacitor, thereby eliminating the capacitor 104. An example value for the DC blocking capacitor 104 is 20 picofarads (pF), but other values are possible. The capacitor 104 and the antenna matching circuit 108 can be referred to as the antenna matching assembly 144.

The RF choke 106 prevents RF energy from entering the DC battery circuit 134. In an embodiment, the RF choke 106 can be implemented using an inductive element having an example value of 100 nanohenrys (nH). The RF choke 106 and the battery circuit 134 can be referred to as the battery circuit assembly 142. A capacitor 146 can be coupled at the output of the RF choke 106 to RF ground 109. In an embodiment, a single ground plane comprises both the DC ground 111 and the RF ground 109. The capacitor 146 is referred to as a "bypass capacitor" and prevents RF noise from entering the DC circuit 134.

Figure 2:
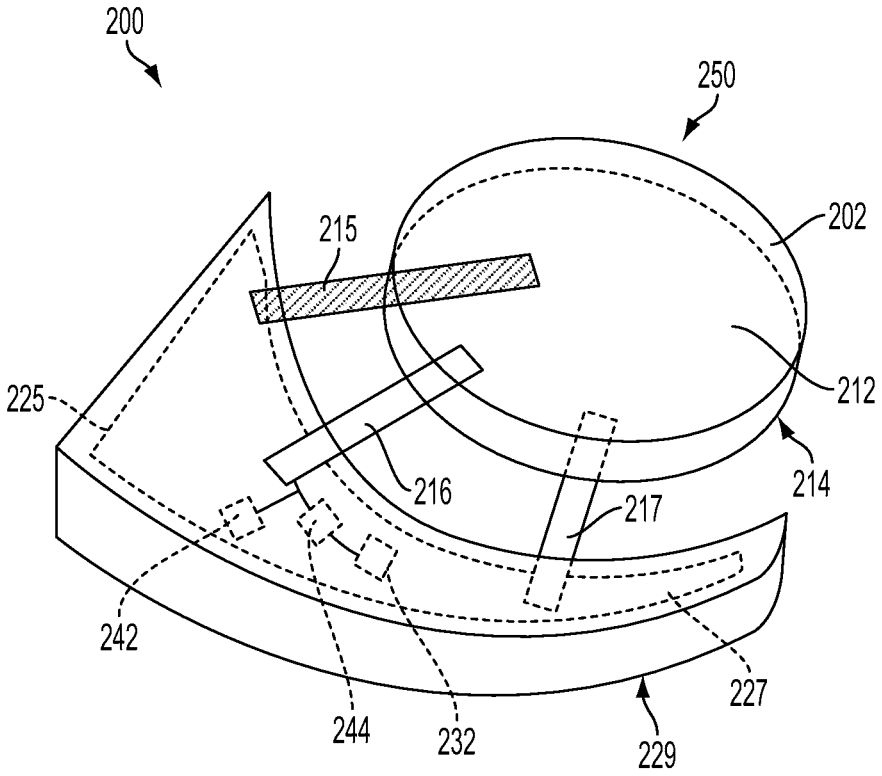
FIG. 2 is a perspective view of an embodiment of a circuit assembly having a battery antenna and a secondary radiator.

FIG. 2 is a perspective view of an embodiment of a circuit assembly having a battery antenna and a secondary radiator. The elements of FIG. 2 will be referred to using the nomenclature 2XX, where the XX denotes items in FIG. 2 that are similar to items labeled 1XX in FIG. 1. As an example, the battery 102 in FIG. 1 corresponds to the battery 202 in FIG. 2. The circuit assembly 200 comprises a battery 202 and a circuit card assembly 225. The positive contact 212 of the battery 202 is coupled to the circuit card assembly 225 by the conductor 216. The negative contact 214 of the battery 202 is coupled to the circuit card assembly 225 by the conductor 217. In this example, a ground plane 227 is fabricated of a metal or a metallic material and is located over at least portions of the underside surface 229 of the circuit card assembly 225. The conductor 217 electrically connects the ground plane 227 to the negative contact 214 of the battery 202. A support structure (not shown in FIG. 2) mechanically locates the battery 202 in relation to the circuit card assembly 225.

A battery circuit assembly 242 and an antenna matching assembly 244 are located on the circuit card assembly 225 and are electrically connected to the conductor 216. An RF circuit 232 is electrically connected to the antenna matching assembly 244.

In an embodiment, a secondary radiator 215 is electrically and mechanically coupled to the ground plane 227, and extends under the battery 202. In this embodiment, the secondary radiator 215 does not electrically connect to the negative contact 214 of the battery 202.

The battery 202 and the secondary radiator 215 form the basic components of a battery module 250 that can be incorporated into any of a number of communication devices. In the example shown in FIG. 2, the battery module 250 comprises the battery 202, the secondary radiator 215, the conductor 216, the conductor 217 and the circuit card assembly 225. The battery circuit assembly 242, the antenna matching assembly 244 and the RF circuit 232 are illustrated in dotted line in FIG. 2 to illustrate that they are optional structures that need not be included with the battery module 250.

Figure 3:
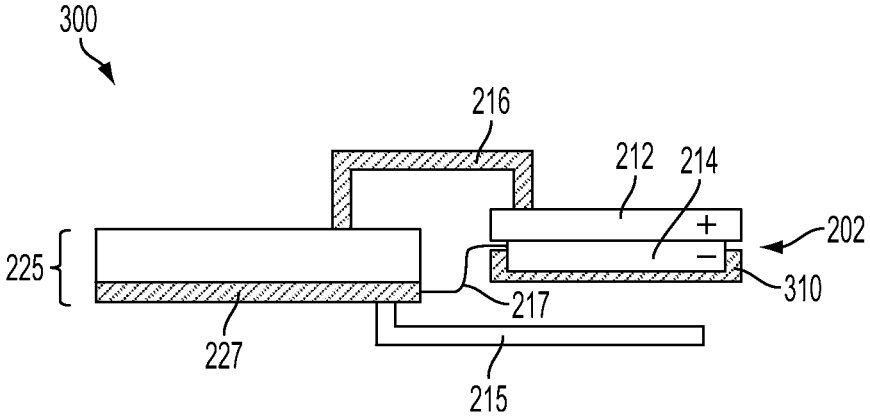
FIG. 3 is a cross-sectional view of the embodiment of the circuit assembly of FIG. 2.

FIG. 3 is a cross-sectional view 300 of the embodiment of the circuit assembly of FIG. 2. The battery 202 is shown located over a support structure 310. The support structure 310 locates the battery 202 in proper relation to the circuit card assembly 225. The positive contact 212 of the battery 202 is coupled to the circuit card assembly 225 by the conductor 216. The negative contact 214 of the battery 202 is coupled to the circuit card assembly 225 by the conductor 217. The ground plane 227 is fabricated of a metal or a metallic material and is located over at least portions of the underside surface 229 of the circuit card assembly 225. Although shown schematically as being separate grounds, the RF ground 109 and the DC ground 111, in some embodiments, are combined in a single ground plane 227 on the CCA 225. The conductor 217 electrically connects the DC ground of the CCA 225 to the negative contact 214 of the battery 202.

The parasitic coupling between the secondary radiator 215 and the positive contact 212 of the battery 202 depends on the relative positioning of the secondary radiator 215 with respect to the positive contact 212 of the battery 202 and other factors. The parasitic coupling is determined by the relative positioning of the secondary radiator 215 including the distance between the secondary radiator 215 and the positive contact 212 of the battery 202, the pattern, shape, configuration and physical characteristics of the secondary radiator 215, as well as the location from which the secondary radiator 215 originates from the CCA 225.

The secondary radiator 215 improves the performance of the antenna formed by the positive contact 212 of the battery 202. Improving the performance of the antenna allows for a broader reception and transmission bandwidth of a communication device. This allows for communication over multiple frequency bands or allows for an increase in the bandwidth of a single communication band. In an embodiment, the secondary radiator 215 increases the reception and transmission bandwidth of a communication device operating in a predetermined frequency range of approximately 2.4 GHz to approximately 2.5 GHz. In another embodiment, the secondary radiator 215 can be tuned to add an additional reception and transmission band to a communication device. Antenna performance parameters include, as a non-limiting example, receive sensitivity, receive pattern, radiated power, radiated pattern, radiation efficiency, etc.

Figure 4:
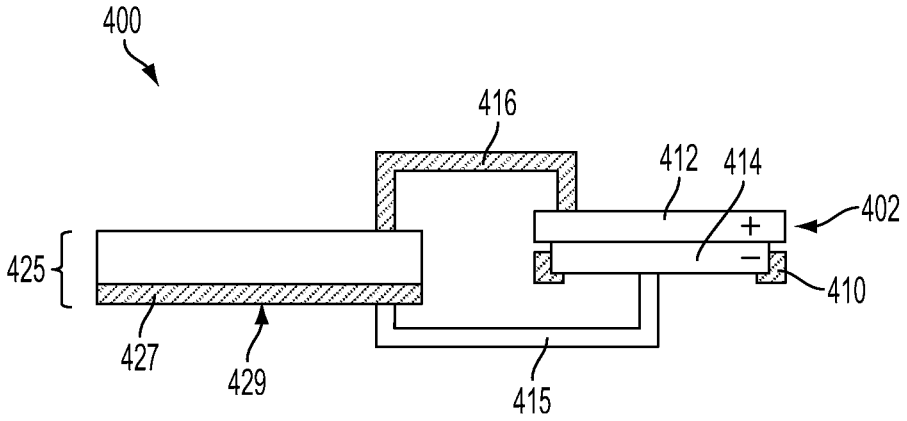
FIG. 4 is a cross-sectional view of an alternative embodiment of the circuit assembly of FIGS. 2 and 3.

FIG. 4 is a cross-sectional view 400 of an alternative embodiment of the circuit assembly of FIGS. 2 and 3. The elements of FIG. 4 will be referred to using the nomenclature 4XX, where the XX denotes items in FIG. 4 that are similar to items labeled 1XX in FIG. 1. The view 400 illustrates an implementation in which the secondary radiator 415 is connected directly between the negative contact 414 of the battery 402 and the ground plane 427 of the CCA 425. In this embodiment, the secondary radiator 415 is used as both the conductor that couples the negative contact 414 of the battery 402 to the ground plane 427 and as the secondary radiating element.

The battery 402 is shown located over a support structure 410. The support structure 410 locates the battery 402 in proper relation to the circuit card assembly 425. The positive contact 412 of the battery 402 is coupled to the circuit card assembly 425 by the conductor 416. The ground plane 427 is fabricated of a metal or a metallic material and is located over at least portions of the underside surface 429 of the circuit card assembly 425.

The parasitic coupling between the secondary radiator 415 and the positive contact 412 of the battery 402 depends on the relative positioning of the secondary radiator 415 with respect to the positive contact 412 of the battery 402 and other factors, as described above.

Figure 5:
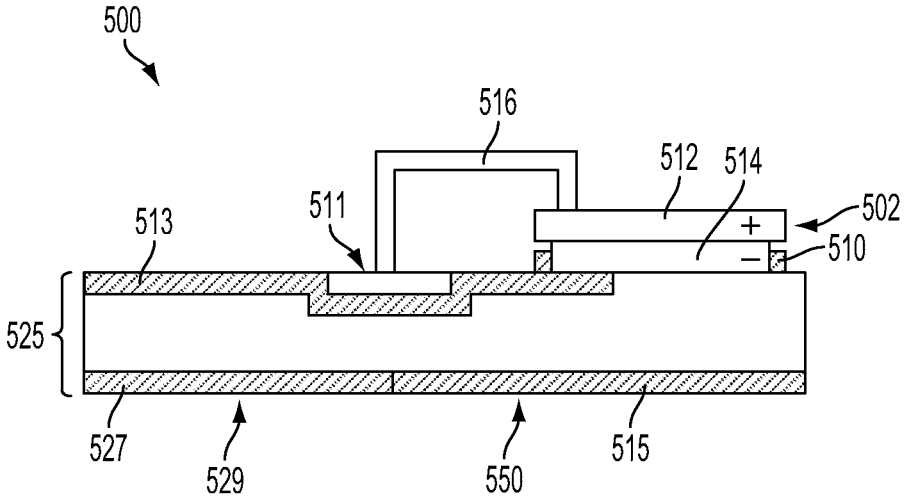
FIG. 5 is a cross-sectional view of another alternative embodiment of the circuit assembly of FIGS. 2 and 3.

FIG. 5 is a cross-sectional view 500 of an alternative embodiment of the circuit assembly of FIGS. 2 and 3. The elements of FIG. 5 will be referred to using the nomenclature 5XX, where the XX denotes items in FIG. 5 that are similar to items labeled 1XX in FIG. 1. The view 500 illustrates an implementation in which the circuit card assembly 525 extends at least partially adjacent to the battery 502. In the example shown in FIG. 5, the circuit card assembly 525 extends at least partially below or under the battery 502. Having the circuit card assembly 525 extend at least partially under the battery 502 removes the separate mechanical connection between the secondary radiator (215, FIGS. 2 and 3; 415, FIG. 4) and the ground plane (227, (FIGS. 2 and 3; 427, FIG. 4).

The battery 502 is located by a support structure 510. In the example shown in FIG. 5, the support structure 510 locates the battery 502 on a surface 511 of the circuit card assembly 525. The positive contact 512 of the battery 502 is coupled to the circuit card assembly 525 by the conductor 516. In the example shown in FIG. 5, a separate DC ground layer 513 is located substantially on the surface 511 of the circuit card assembly 525. However, to prevent the conductor 516 from making electrical contact with and grounding against the DC ground layer 513, the DC ground layer 513 is constructed so as to avoid the conductor 516 as shown.

The negative contact 514 of the battery 502 is coupled directly to the DC ground layer 513 on the surface 511 of the circuit card assembly 525. The ground plane 527 is fabricated of a metal or a metallic material and is located over at least portions of the underside surface 529 of the circuit card assembly 525.

In the embodiment shown in FIG. 5, the ground plane 527 also comprises a portion 550 that can be fabricated to implement the secondary radiator 515. As an example, the portion 550 of the ground plane 527 can be patterned, formed, or otherwise constructed as an extension of the ground plane 527 and can function as the secondary radiator 515. Although illustrated a being the same thickness as the ground plane 527, the portion 550 of the ground plane 527 that forms the secondary radiator 515 can be thicker or thinner than the ground plane 527, depending on the configuration of the secondary radiator 515.

The parasitic coupling between the secondary radiator 515 and the positive contact 512 of the battery 502 depends on the relative positioning of the secondary radiator 515 with respect to the positive contact 512 of the battery 502, and other factors, as described above.

Figure 6:
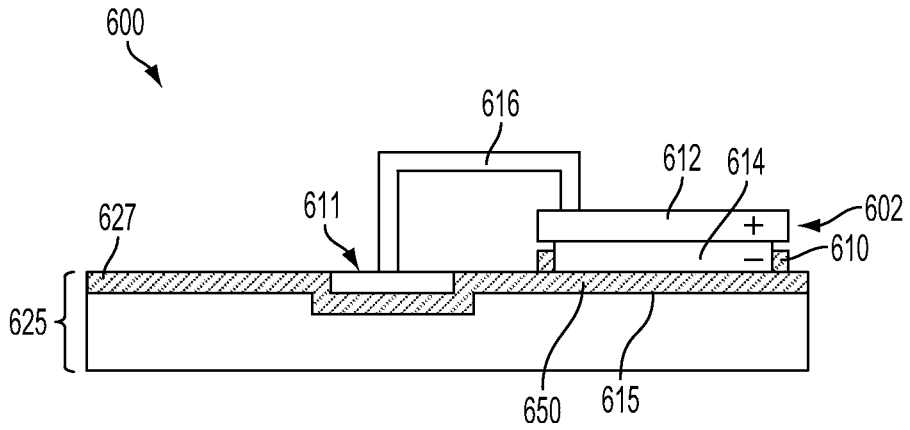
FIG. 6 is a cross-sectional view of another alternative embodiment of the circuit assembly of FIGS. 2 and 3.

FIG. 6 is a cross-sectional view 600 of another alternative embodiment of the circuit assembly of FIGS. 2 and 3. The elements of FIG. 6 will be referred to using the nomenclature 6XX, where the XX denotes items in FIG. 6 that are similar to items labeled 1XX in FIG. 1. The view 600 illustrates an implementation in which the circuit card assembly 625 extends at least partially adjacent to the battery 602 and in which the RF ground plane and the DC ground plane are combined into a single structure embodied by ground plane 627. In the example shown in FIG. 6, the circuit card assembly 625 extends at least partially below or under the battery 602, similar to that described in FIG. 5. The single ground plane 627 is formed on the surface 611 and also extends under the battery 602. Having the single ground plane 627 extend under the battery 602 allows the negative contact 614 of the battery 602 to make a direct mechanical and electrical connection with the single ground plane 627.

The battery 602 is located by a support structure 610. In the example shown in FIG. 6, the support structure 610 locates the battery 602 on a surface 611 of the circuit card assembly 625. The positive contact 612 of the battery 602 is coupled to the circuit card assembly 625 by the conductor 616. In the example shown in FIG. 6, the single ground plane 627 is located substantially on the surface 611 of the circuit card assembly 625. However, to prevent the conductor 616 from grounding against the single ground plane 627, the single ground plane 627 is constructed so as to avoid the conductor 616 as shown.

The negative contact 614 of the battery 602 is coupled directly to the single ground plane 627 on the surface 611 of the circuit card assembly 625. In the embodiment shown in FIG. 6, the single ground plane 627 also comprises a portion 650 that can be fabricated to implement the secondary radiator 615. As an example, the portion 650 of the single ground plane 627 can be patterned, formed, or otherwise constructed as an extension of the single ground plane 627 and can function as the secondary radiator 615 and as the mechanical and electrical connection between the negative contact 614 of the battery 602 and the single ground plane 627. Although illustrated a being the same thickness as the ground plane 627, the portion 650 of the ground plane 627 that forms the secondary radiator 615 can be thicker or thinner than the ground plane 627, depending on the configuration of the secondary radiator 615.

The parasitic coupling between the secondary radiator 615 and the positive contact 612 of the battery 602 depends on the relative positioning of the secondary radiator 615 with respect to the positive contact 612 of the battery 602, and other factors, as described above.

Figure 7A:
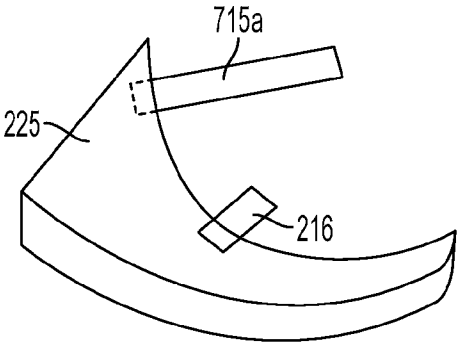
FIGS. 7A through 7E are diagrams illustrating example locations of the secondary radiator of FIGS. 1 through 6.

FIGS. 7A through 7E are diagrams illustrating example locations of the secondary radiator of FIGS. 1 through 6. Although shown in FIGS. 7A through 7E as being metal or metallic material, the structures can also be patterned on a layer of circuit card material as described in FIGS. 5 and 6. FIG. 7A shows the portion of the circuit card assembly 225 having a conductor 216 and a first embodiment of a secondary radiator 715*a*. The secondary radiator 715*a* can be fabricated as a metal or metallic arm, similar to that described in FIGS. 2, 3 and 4.

Figure 7B:
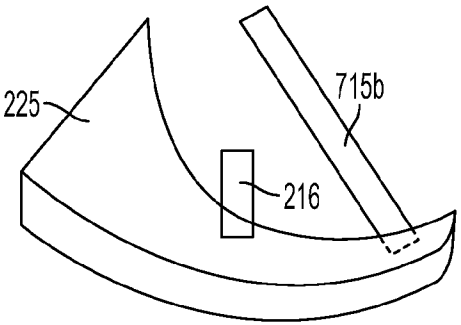

FIG. 7B shows the portion of the circuit card assembly 225 having a conductor 216 and a second embodiment of a secondary radiator 715*b*. The secondary radiator 715*b* can be fabricated as a metal or metallic arm, similar to that described in FIGS. 2, 3 and 4, but located at a different location with respect to the circuit card assembly 225.

Figure 7C:
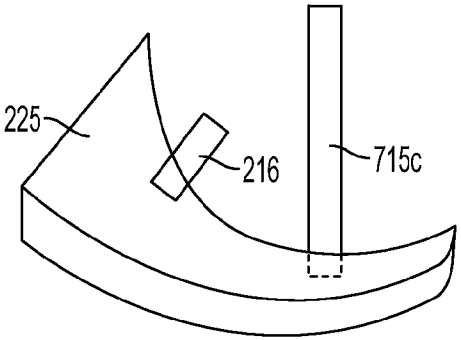

FIG. 7C shows the portion of the circuit card assembly 225 having a conductor 216 and a second embodiment of a secondary radiator 715*c*. The secondary radiator 715*c* can be fabricated as a metal or metallic arm, similar to that described in FIGS. 2, 3 and 4 but located at a different location with respect to the circuit card assembly 225.

Figure 7D:
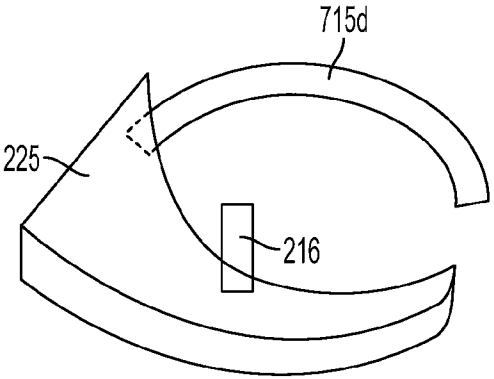

FIG. 7D shows the portion of the circuit card assembly 225 having a conductor 216 and a second embodiment of a secondary radiator 715*d*. The secondary radiator 715*d* can be fabricated as a curved or arcuate metal or metallic arm.

Figure 7E:
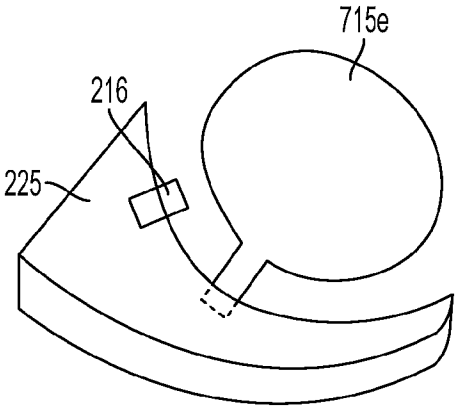

FIG. 7E shows the portion of the circuit card assembly 225 having a conductor 216 and a second embodiment of a secondary radiator 715E. The secondary radiator 715*e* can be fabricated as a metal or metallic structure having a paddle shape. The examples shown in FIGS. 7A through 7E are a few of the many shapes from which the secondary radiator can be formed.

Figure 8A:
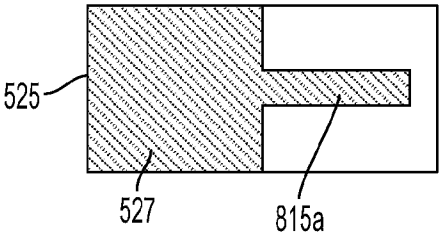
FIGS. 8A through 8F are diagrams illustrating example structures of the secondary radiator of FIGS. 1 through 6.

FIGS. 8A through 8F are diagrams illustrating example structures of the secondary radiator of FIGS. 1 through 6. Although shown in FIGS. 8A through 8F as being patterned on a circuit card assembly as shown in FIGS. 5 and 6, the structures can also be fabricated from a metal or metallic material as described in FIGS. 2, 3 and 4. FIG. 8A shows the portion of the circuit card assembly 525 having the ground plane 527 (FIG. 5). A first embodiment of the secondary radiator 815*a* is illustrated as a metal or metallic structure patterned or otherwise formed using the material from which the ground plane 527 is formed.

Figure 8B:
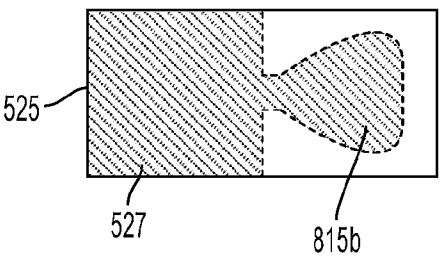

FIG. 8B shows the portion of the circuit card assembly 525 having the ground plane 527 (FIG. 5). A second embodiment of the secondary radiator 815*b* is illustrated as a metal or metallic structure patterned or otherwise formed using the material from which the ground plane 527 is formed.

Figure 8C:
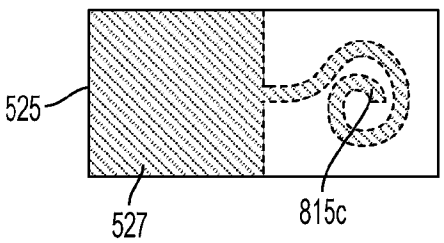

FIG. 8C shows the portion of the circuit card assembly 525 having the ground plane 527 (FIG. 5). A third embodiment of the secondary radiator 815*c* is illustrated as a metal or metallic structure patterned or otherwise formed using the material from which the ground plane 527 is formed.

Figure 8D:
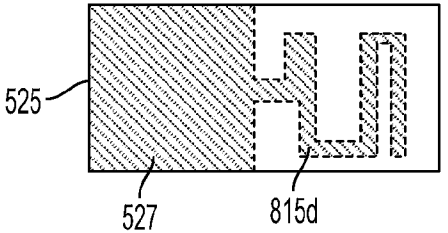

FIG. 8D shows the portion of the circuit card assembly 525 having the ground plane 527 (FIG. 5). A fourth embodiment of the secondary radiator 815*d* is illustrated as a metal or metallic structure patterned or otherwise formed using the material from which the ground plane 527 is formed.

Figure 8E:
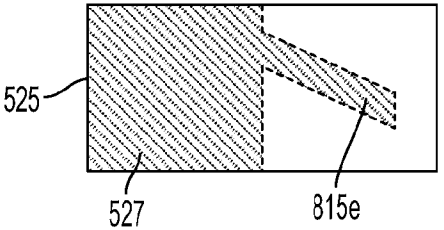

FIG. 8E shows the portion of the circuit card assembly 525 having the ground plane 527 (FIG. 5). A fifth embodiment of the secondary radiator 815*e* is illustrated as a metal or metallic structure patterned or otherwise formed using the material from which the ground plane 527 is formed.

Figure 8F:
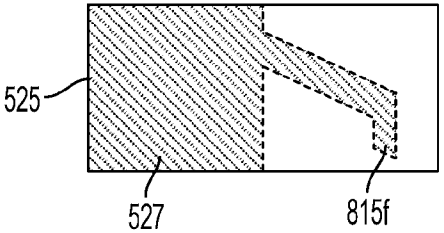

FIG. 8F shows the portion of the circuit card assembly 525 having the ground plane 527 (FIG. 5). A sixth embodiment of the secondary radiator 815*f* is illustrated as a metal or metallic structure patterned or otherwise formed using the material from which the ground plane 527 is formed.

Alternatively, the secondary radiators 815*a* through 815*f* can be formed from the single ground plane 627 (FIG. 6) and the location of any of these secondary radiators could be in any location as explained in FIGS. 7A through 7F.

Figure 9:
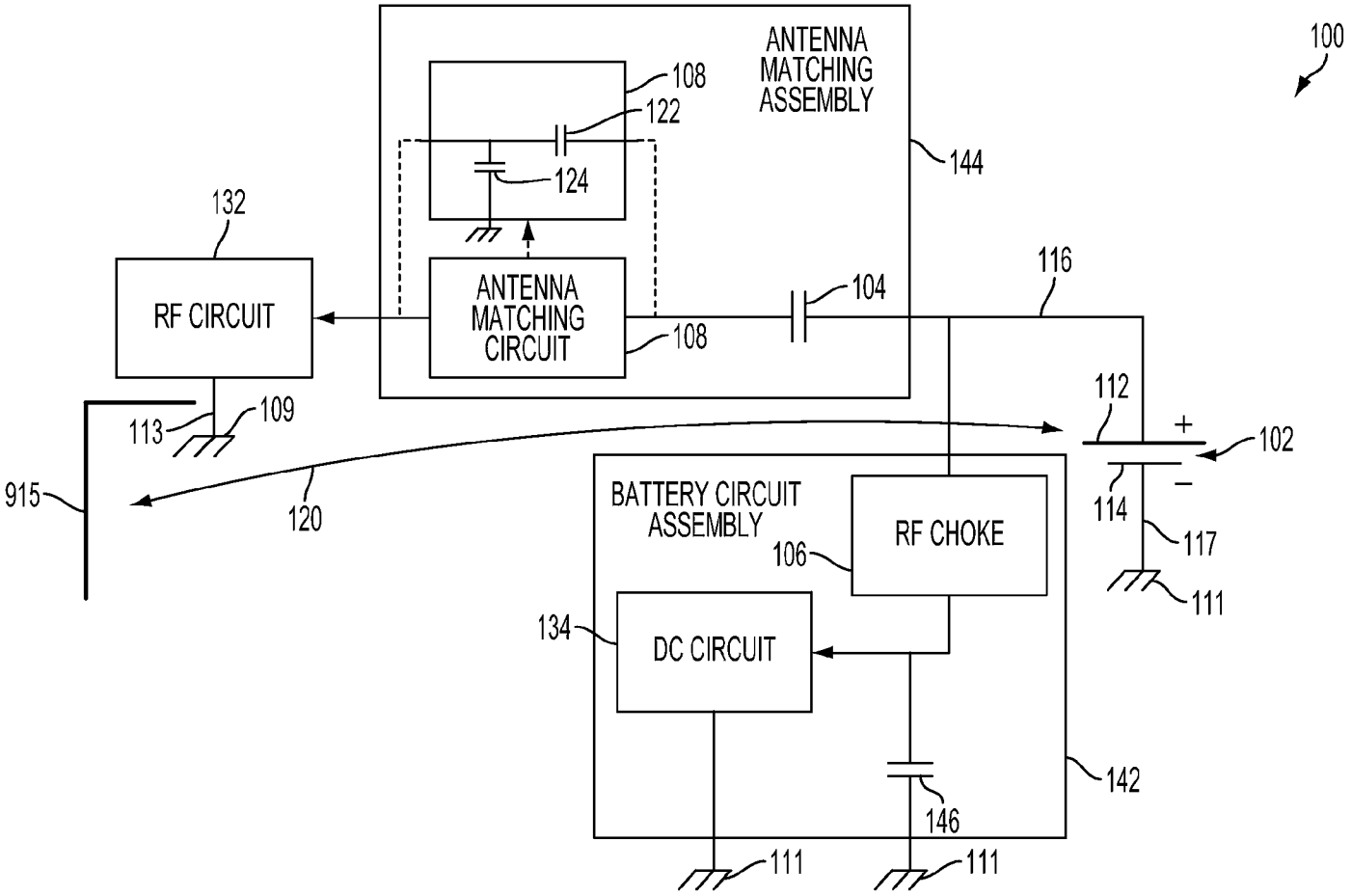
FIG. 9 shows a block diagram of an alternative embodiment of the circuit shown in FIG. 1.

FIG. 9 shows a block diagram of an alternative embodiment of the circuit shown in FIG. 1. The elements in FIG. 9 that correspond to the elements in FIG. 1 are identically labeled and will not be described again in detail. In the embodiment shown in FIG. 9, the radiator element 915 is isolated from the RF ground 109. However, parasitic coupling, illustrated using reference numeral 120, occurs between the radiator element 915 and the positive contact 112 of the battery 102, thus improving the performance of the battery 102 when the battery 102 is used as an antenna without being physically or mechanically connected to the positive contact 112 of the battery 102.

Figure 10C:
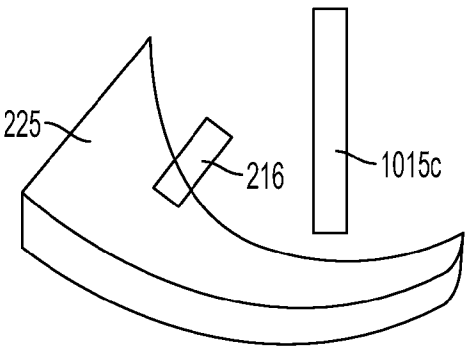
FIGS. 10A through 10E are diagrams illustrating example locations of the secondary radiator of FIG. 9.
Figure 10B:
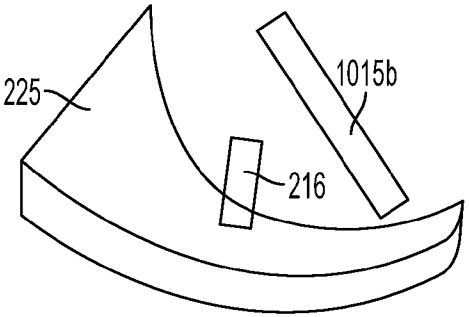
Figure 10A:
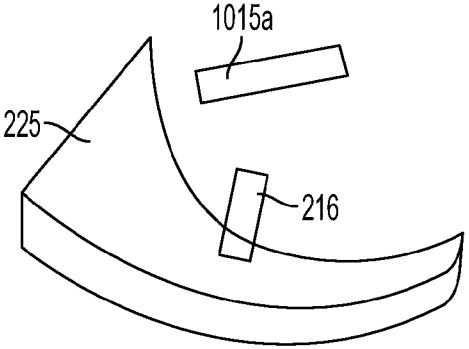
Figure 10E:
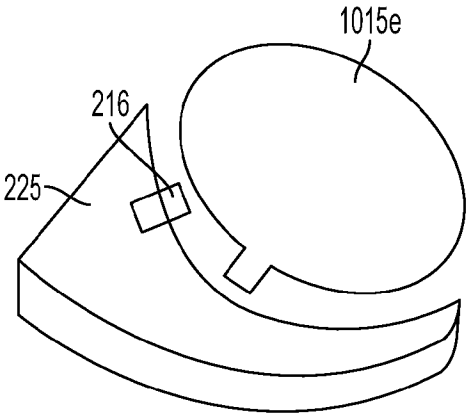
Figure 10D:
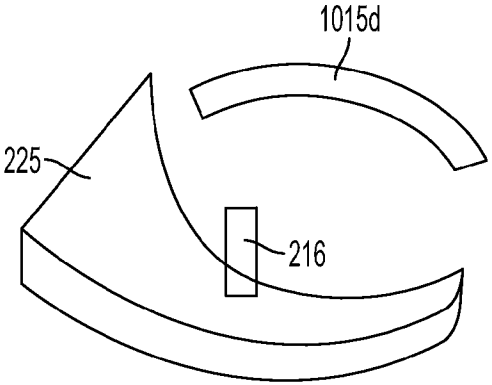

FIGS. 10A through 10E are diagrams illustrating example locations of the secondary radiator of FIG. 9. Although shown in FIGS. 10A through 10E as being metal or metallic material, the structures can also be patterned on a layer of circuit card material as described in FIGS. 5 and 6. FIG. 10A shows the portion of the circuit card assembly 225 having a conductor 216 and a first embodiment of a secondary radiator 1015*a*. The secondary radiator 1015*a* can be fabricated as a metal or metallic arm, similar to that described in FIGS. 2, 3 and 4, but is isolated from the RF ground, as shown in FIG. 9. FIGS. 10B through 10E show alternative locations and structures of the secondary radiator of FIG. 9. The examples shown in FIGS. 10A through 10E are a few of the many shapes from which the secondary radiator can be formed. Further, the structures and shapes of the secondary radiators shown in FIGS. 8A through 8F can also be implemented as isolated from the RF ground, as described in FIG. 9. In such embodiments where the secondary radiator is not physically connected to the RF ground, the positive contact of the battery or the negative contact of the battery, the secondary radiator can be a metal or metallic structure that is located in the vicinity of any of the positive contact 112 or the negative contact 114 of the battery 102, such that parasitic coupling can occur between the secondary radiator and any of the positive contact 112 or the negative contact 114 of the battery 102.

Figure 11:
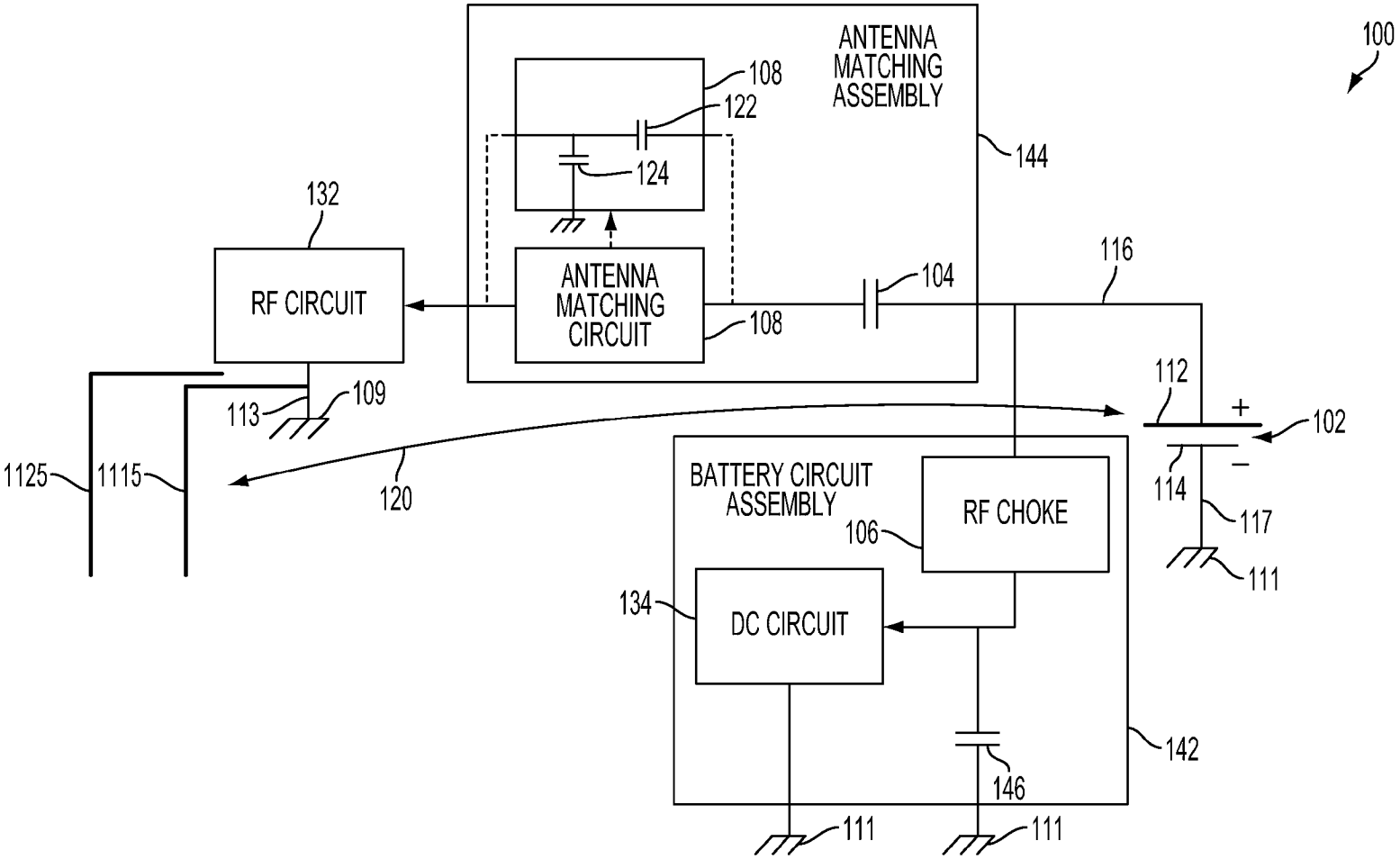
FIG. 11 shows a block diagram of an alternative embodiment of the circuit shown in FIG. 1 and FIG. 9.

FIG. 11 shows a block diagram of an alternative embodiment of the circuit shown in FIG. 1 and FIG. 9. The elements in FIG. 11 that correspond to the elements in FIG. 1 and FIG. 9 are identically labeled and will not be described again in detail. In the embodiment shown in FIG. 11, a radiator element 1115 is shown as being connected to the RF ground 109 and a radiator element 1125 is shown as being isolated from the RF ground 109. In this embodiment, two secondary radiators are implemented. However, parasitic coupling, illustrated using reference numeral 120, occurs between the radiator elements 1115 and 1125 and the positive contact 112 of the battery 102, thus improving the performance of the battery 102 when the battery 102 is used as an antenna without being physically or mechanically connected to the positive contact 112 of the battery 102.

Other combinations of radiating elements can also be implemented, including, for example, one radiating element connected to the RF ground and two or more radiating elements isolated from the RF ground, and two or more radiating elements connected to the RF ground.

Figure 12C:
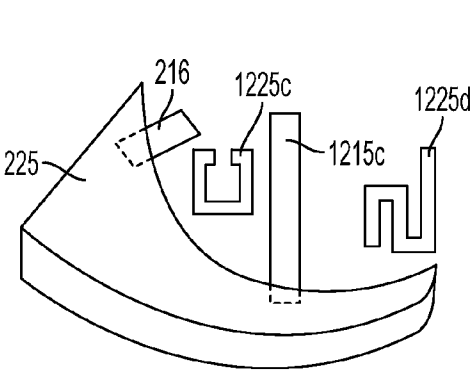
FIGS. 12A through 12E are diagrams illustrating example locations of the secondary radiators of FIG. 11.
Figure 12B:
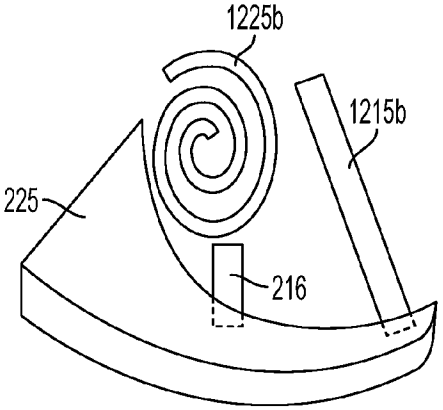
Figure 12A:
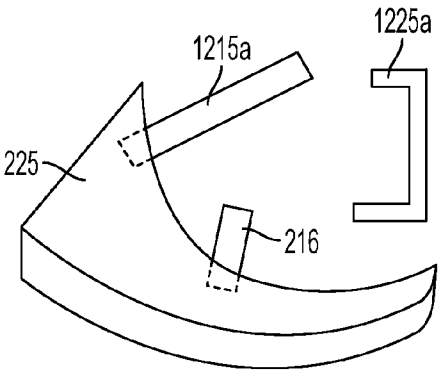

FIGS. 12A through 12E are diagrams illustrating example locations of the secondary radiators of FIG. 11. Although shown in FIGS. 12A through 12E as being metal or metallic material, the structures can also be patterned on a layer of circuit card material as described in FIGS. 5 and 6. FIG. 12A shows the portion of the circuit card assembly 225 having a conductor 216 and a first embodiment of a secondary radiator 1215*a* and a secondary radiator 1225*a*. The secondary radiator 1215*a* is illustrated as being connected to the RF ground (not shown in FIG. 12A) and the secondary radiator 1225*a* is shown as being isolated from the RF ground.

FIG. 12B shows the portion of the circuit card assembly 225 having a conductor 216 and a second embodiment of a secondary radiator 1215*b* and a secondary radiator 1225*b*. The secondary radiator 1215*b* is illustrated as being connected to the RF ground (not shown in FIG. 12B) and the secondary radiator 1225*b* is shown as being isolated from the RF ground.

FIG. 12C shows the portion of the circuit card assembly 225 having a conductor 216 and a third embodiment of a secondary radiator 1215*c* and secondary radiators 1225*c* and 1225*d*. The secondary radiator 1215*c* is illustrated as being connected to the RF ground (not shown in FIG. 12C) and the secondary radiators 1225*c* and 1225*d* are shown as being isolated from the RF ground.

Figure 12E:
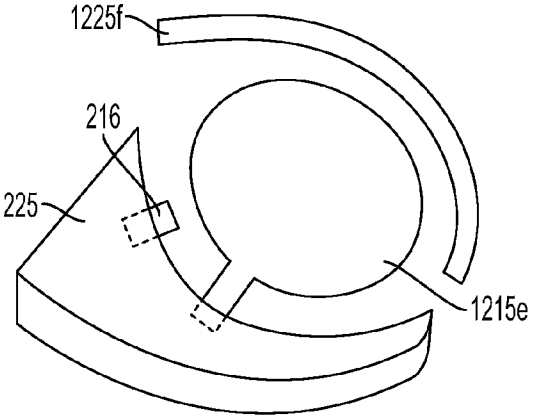
Figure 12D:
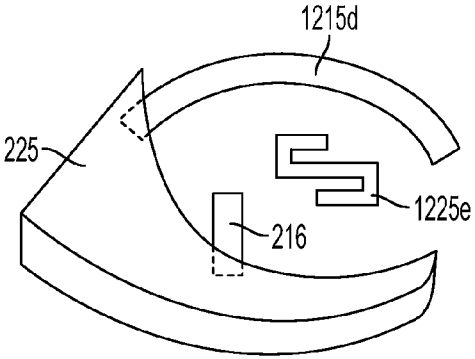

FIG. 12D shows the portion of the circuit card assembly 225 having a conductor 216 and a fourth embodiment of a secondary radiator 1215*d* and a secondary radiator 1225*e*. The secondary radiator 1215*d* is illustrated as being connected to the RF ground (not shown in FIG. 12D) and the secondary radiator 1225*e* is shown as being isolated from the RF ground.

FIG. 12E shows the portion of the circuit card assembly 225 having a conductor 216 and a fifth embodiment of a secondary radiator 1215*e* and a secondary radiator 1225*f*. The secondary radiator 1215*e* is illustrated as being connected to the RF ground (not shown in FIG. 12E) and the secondary radiator 1225*f* is shown as being isolated from the RF ground.

The examples shown in FIGS. 12A through 12E are a few of the many shapes from which the secondary radiators can be formed. Further, the structures and shapes of the secondary radiators shown in FIGS. 8A through 8F can also be implemented as being connected to or being isolated from the RF ground, as described in FIG. 11. In such embodiments where a secondary radiator is not physically connected to the RF ground, the positive contact of the battery or the negative contact of the battery, the secondary radiator can be a metal or metallic structure that is located in the vicinity of any of the positive contact 112 or the negative contact 114 of the battery 102, such that parasitic coupling can occur between the secondary radiator and any of the positive contact 112 or the negative contact 114 of the battery 102.

Figure 13A:
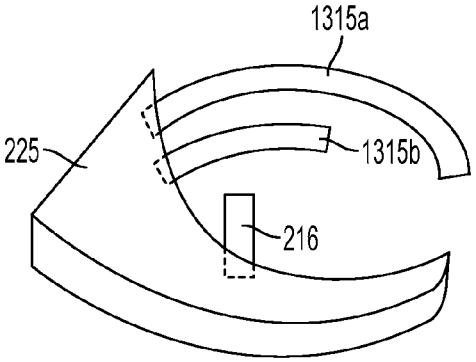
FIGS. 13A through 13D are diagrams illustrating example locations of the secondary radiators of FIG. 11 when more than one secondary radiator is connected to an RF ground.

FIGS. 13A through 13D are diagrams illustrating example locations of the secondary radiators of FIG. 11 when more than one secondary radiator is connected to an RF ground. Although shown in FIGS. 13A through 13D as being metal or metallic material, the structures can also be patterned on a layer of circuit card material as described in FIGS. 5 and 6. FIG. 13A shows the portion of the circuit card assembly 225 having a conductor 216 and a first embodiment of a secondary radiator 1315*a* and a secondary radiator 1315*b*. The secondary radiators 1315*a* and 1315*b* are illustrated as being connected to the RF ground (not shown in FIG. 13A).

Figure 13B:
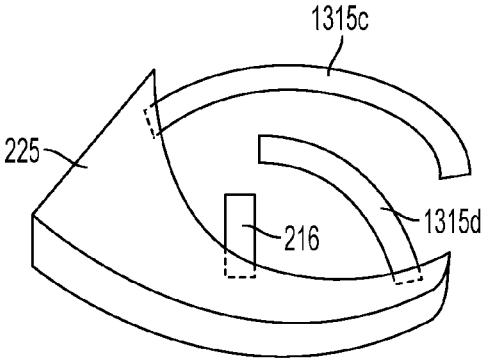

FIG. 13B shows the portion of the circuit card assembly 225 having a conductor 216 and a second embodiment of a secondary radiator 1315*c* and a secondary radiator 1315*d*. The secondary radiators 1315*c* and 1315*d* are illustrated as being connected to the RF ground (not shown in FIG. 13B).

Figure 13C:
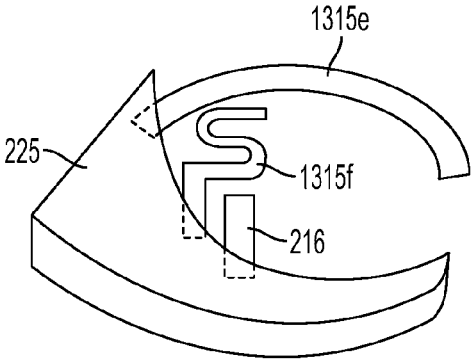

FIG. 13C shows the portion of the circuit card assembly 225 having a conductor 216 and a third embodiment of a secondary radiator 1315*e* and a secondary radiator 1315*f*. The secondary radiators 1315*e* and 1315*f* are illustrated as being connected to the RF ground (not shown in FIG. 13D).

Figure 13D:
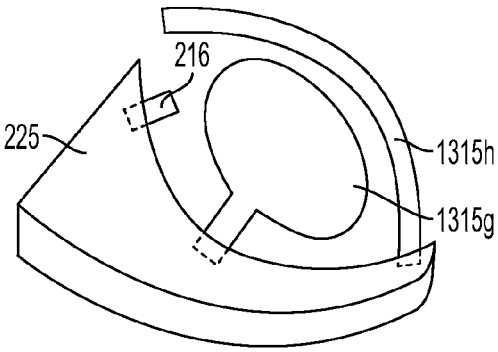

FIG. 13D shows the portion of the circuit card assembly 225 having a conductor 216 and a fourth embodiment of a secondary radiator 1315*g* and a secondary radiator 1315*h*. The secondary radiators 1315*g* and 1315*h* are illustrated as being connected to the RF ground (not shown in FIG. 13D).

Figure 14:
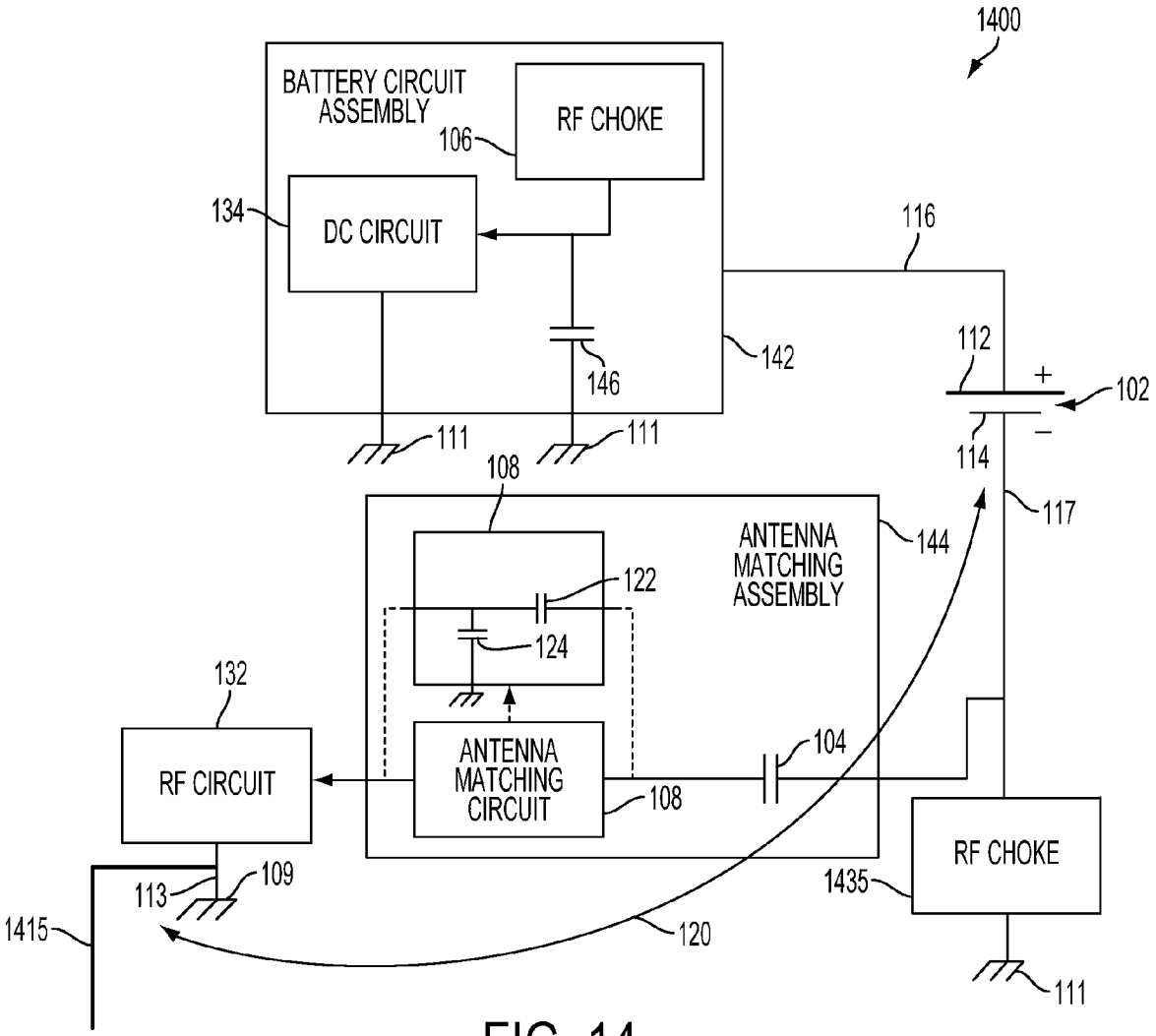
FIG. 14 shows a block diagram of a circuit having an alternative embodiment of a combination battery antenna with a secondary radiator.

FIG. 14 shows a block diagram of a circuit 1400 having an alternative embodiment of a combination battery antenna with a secondary radiator. The elements in FIG. 14 that correspond to elements in FIG. 1 are identically labeled and will not be described again in detail. The circuit 1400 illustrates an embodiment of the combination battery antenna with a secondary radiator in which the negative contact 114 of the battery 102 is used as the antenna. When the negative contact 114 of the battery 102 is used as the antenna, an additional RF choke 1435 is located between the negative contact 114 of the battery 102 and the DC ground 111.

In the embodiment shown in FIG. 14, the radiator element 1415 is electrically coupled to the RF ground 109. In the embodiment shown in FIG. 14, the secondary radiator 1415 is parasitically coupled to the negative contact 114 of the battery 102 so as to improve the performance of the battery 102 as an antenna. This parasitic coupling is illustrated using reference numeral 120. The secondary radiator 1415 can be a metal or metallic structure and can be implemented in the circuit 1400 of FIG. 14 as any of the elements or structures described herein.

Figure 15:
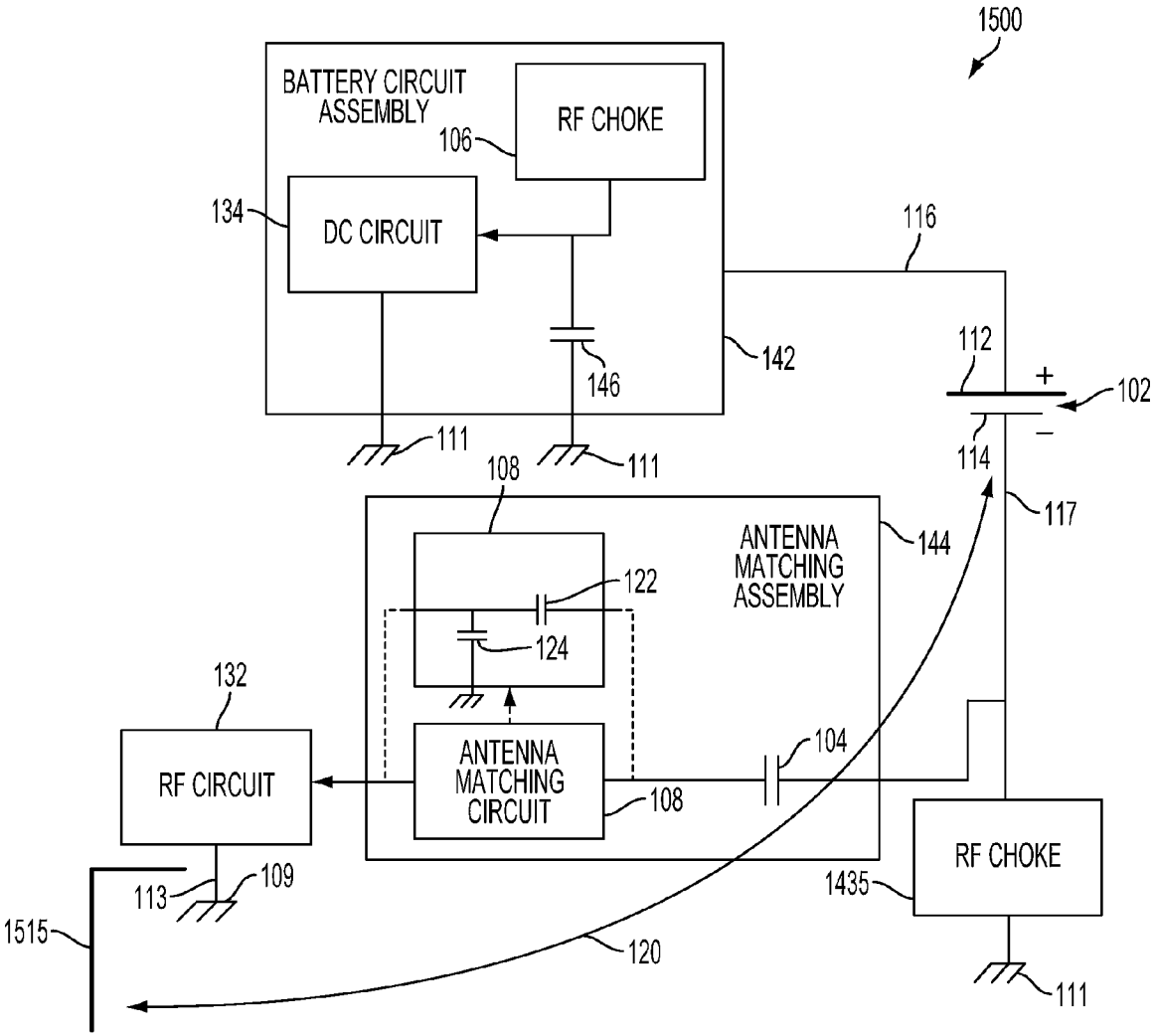
FIG. 15 shows a block diagram of a circuit having an alternative embodiment of the combination battery antenna with a secondary radiator of FIG. 14.

FIG. 15 shows a block diagram of a circuit 1500 having an alternative embodiment of a combination battery antenna with a secondary radiator of FIG. 14. The elements in FIG. 15 that correspond to elements in FIGS. 1 and 14 are identically labeled and will not be described again in detail. The circuit 1500 illustrates an embodiment of the combination battery antenna with a secondary radiator in which the negative contact 114 of the battery 102 is used as the antenna. When the negative contact 114 of the battery 102 is used as the antenna, an additional RF choke 1435 is located between the negative contact 114 of the battery 102 and the DC ground 111.

In the embodiment shown in FIG. 15, the radiator element 1515 is isolated from the RF ground 109. In the embodiment shown in FIG. 15, the secondary radiator 1515 is parasitically coupled to the negative contact 114 of the battery 102 so as to improve the performance of the battery 102 as an antenna. This parasitic coupling is illustrated using reference numeral 120. The secondary radiator 1515 can be a metal or metallic structure and can be implemented in the circuit 1500 of FIG. 15 as any of the elements or structures described herein.

Figure 16:
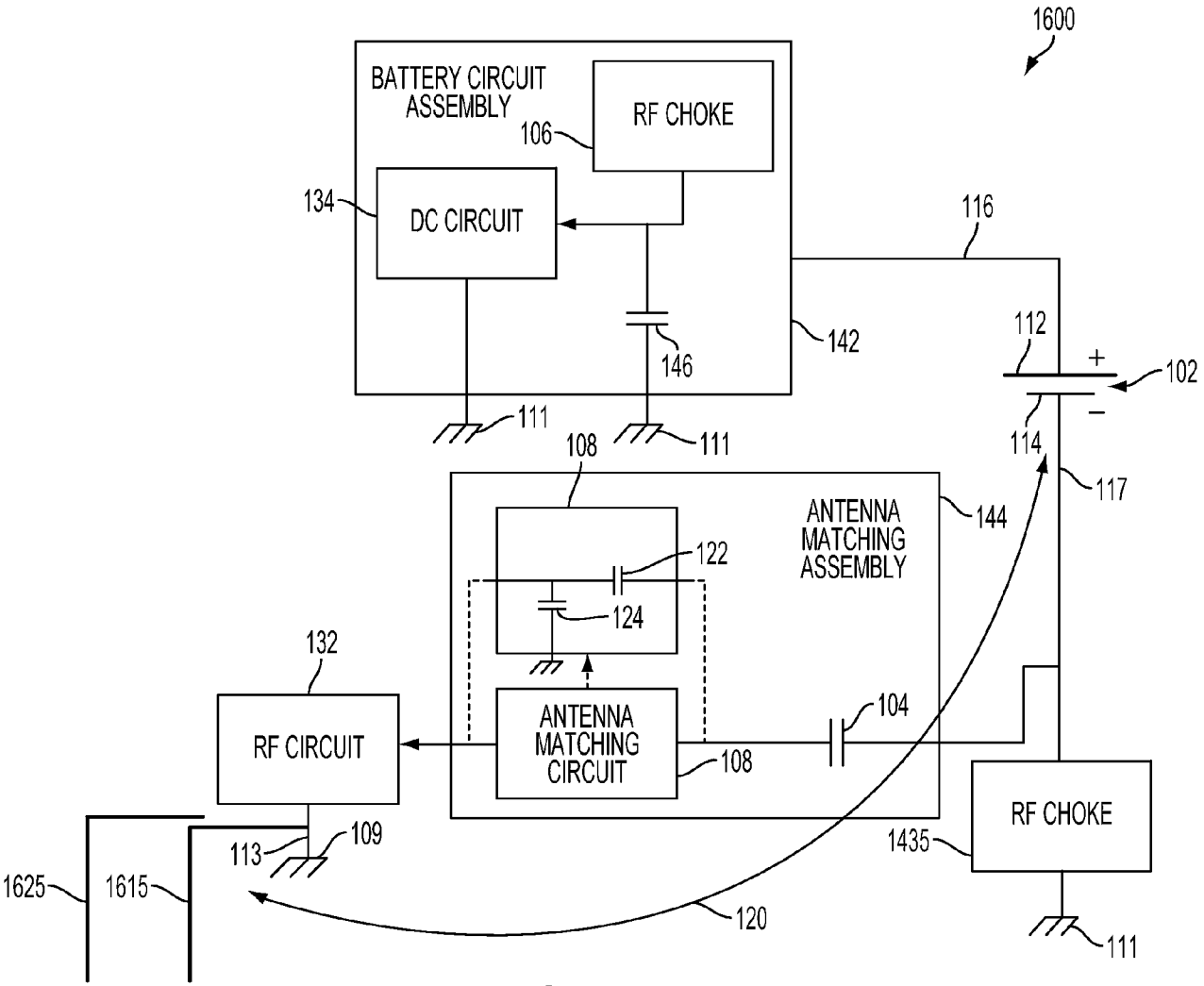
FIG. 16 shows a block diagram of a circuit having another alternative embodiment of the combination battery antenna with a secondary radiator of FIG. 14.

FIG. 16 shows a block diagram of a circuit 1600 having another alternative embodiment of a combination battery antenna with a secondary radiator of FIG. 14. The elements in FIG. 16 that correspond to elements in FIGS. 1 and 14 are identically labeled and will not be described again in detail. The circuit 1600 illustrates an embodiment of the combination battery antenna with a secondary radiator in which the negative contact 114 of the battery 102 is used as the antenna. When the negative contact 114 of the battery 102 is used as the antenna, an additional RF choke 1435 is located between the negative contact 114 of the battery 102 and the DC ground 111.

In the embodiment shown in FIG. 16, a radiator element 1615 is shown as being connected to the RF ground 109 and a radiator element 1625 is shown as being isolated from the RF ground 109. In this embodiment, two secondary radiators are implemented. However, parasitic coupling, illustrated using reference numeral 120, occurs between the radiator elements 1615 and 1625 and the negative contact 114 of the battery 102, thus improving the performance of the battery 102 when the battery 102 is used as an antenna without being physically or mechanically connected to the negative contact 114 of the battery 102. The secondary radiators 1615 and 1625 can be a metal or metallic structure and can be implemented in the circuit 1600 of FIG. 16 as any of the elements or structures described herein.

Other combinations of radiating elements can also be implemented, including, for example, one radiating element connected to the RF ground and two or more radiating elements isolated from the RF ground, and two or more radiating elements connected to the RF ground.

Figure 17:
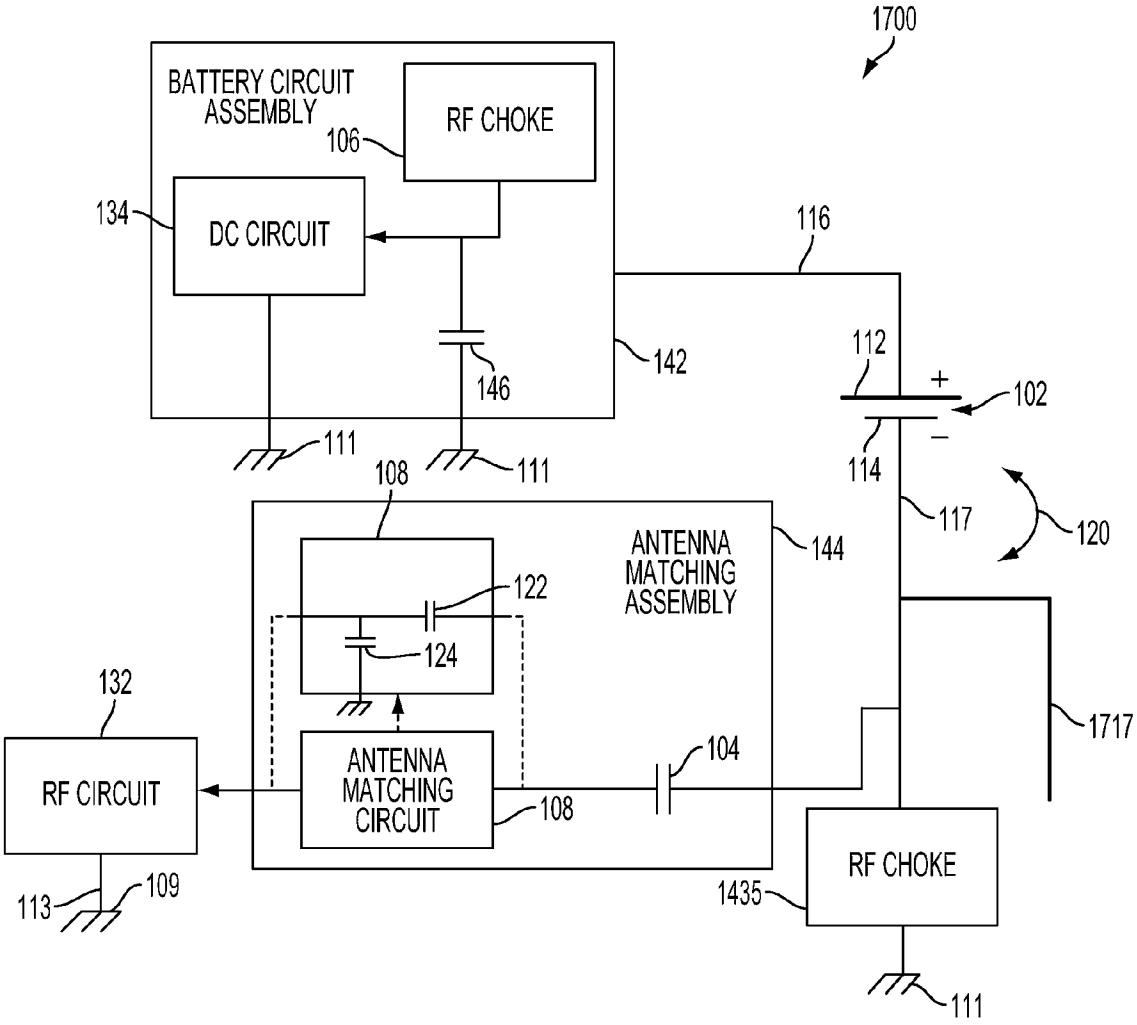
FIG. 17 shows a block diagram of a circuit having another alternative embodiment of a combination battery antenna with a secondary radiator.

FIG. 17 shows a block diagram of a circuit 1700 having another alternative embodiment of a combination battery antenna with a secondary radiator. The elements in FIG. 17 that correspond to elements in FIGS. 1 and 14 are identically labeled and will not be described again in detail. The circuit 1700 illustrates an embodiment of the combination battery antenna with a secondary radiator in which the negative contact 114 of the battery 102 is used as the antenna and in which a secondary radiator 1717 is connected to the negative contact 114 of the battery 102 at node 117. Although not shown in FIG. 17, one or more additional secondary radiators may be connected as described in FIGS. 14 through 16. When the negative contact 114 of the battery 102 is used as the antenna, an additional RF choke 1435 is located between the negative contact 114 of the battery 102 and the DC ground 111.

Parasitic coupling, illustrated using reference numeral 120, occurs between the radiator element 1717 and the negative contact 114 of the battery 102, thus improving the performance of the battery 102 when the battery 102 is used as an antenna. The secondary radiator 1717 can be a metal or metallic structure and can be implemented in the circuit 1700 of FIG. 17 as any of the elements or structures described herein.

Other combinations of radiating elements can also be implemented, including, for example, one radiating element connected to the RF ground and two or more radiating elements isolated from the RF ground, and two or more radiating elements connected to the RF ground.

Figure 18:
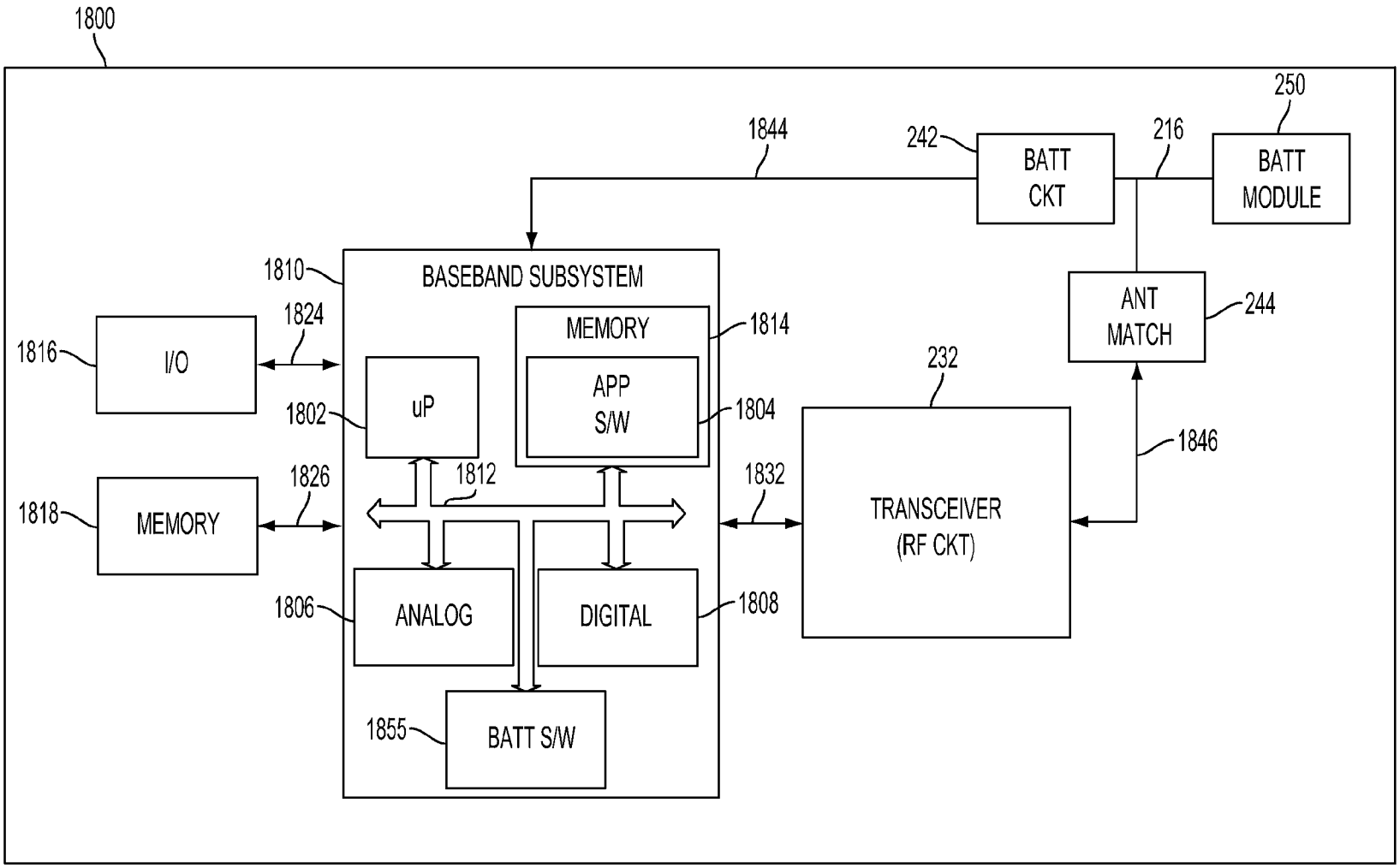
FIG. 18 is a block diagram illustrating an example of a portable communication device in which the battery antenna having a secondary radiator can be implemented.

FIG. 18 is a block diagram illustrating an example of a portable communication device 1800 in which the battery antenna having a secondary radiator can be implemented. In an embodiment, the portable communication device 1800 can be a "Bluetooth" wireless communication device, a portable cellular telephone, a WiFi enable communication device, or can be any other communication device. Embodiments of the battery antenna having a secondary radiator can be implemented in any device having an RF transmitter, receiver or transceiver. The portable communication device 1800 illustrated in FIG. 18 is intended to be a simplified example of a cellular telephone and to illustrate one of many possible applications in which the battery antenna having a secondary radiator can be implemented. One having ordinary skill in the art will understand the operation of a portable cellular telephone, and, as such, implementation details are omitted. The portable communication device 1800 includes a baseband subsystem 1810 and an RF circuit 232. In an embodiment, the RF circuit 232 is a transceiver. Although not shown for clarity, the RF circuit 232 generally includes modulation, upconversion and amplification circuitry for preparing a baseband information signal for transmission, and includes amplification, filtering and downconversion circuitry for receiving and downconverting an RF signal to a baseband information signal to recover data. The details of the operation of the RF circuit 232 are known to those skilled in the art.

The baseband subsystem generally includes a processor 1802, which can be a general purpose or special purpose microprocessor, memory 1814, application software 1804, analog circuit elements 1806, digital circuit elements 1808 and battery software 1855, coupled over a system bus 1812. The system bus 1812 can include the physical and logical connections to couple the above-described elements together and enable their interoperability.

An input/output (I/O) element 1816 is connected to the baseband subsystem 1810 over connection 1824 and a memory element 1818 is coupled to the baseband subsystem 1810 over connection 1826. The I/O element 1816 can include, for example, a microphone, a keypad, a speaker, a pointing device, user interface control elements, and any other devices or system that allow a user to provide input commands and receive outputs from the portable communication device 1800.

The memory 1818 can be any type of volatile or non-volatile memory, and in an embodiment, can include flash memory. The memory element 1818 can be permanently installed in the portable communication device 1800, or can be a removable memory element, such as a removable memory card.

The processor 1802 can be any processor that executes the application software 1804 to control the operation and functionality of the portable communication device 1800. The memory 1814 can be volatile or non-volatile memory, and in an embodiment, can be non-volatile memory that stores the application software 1804. If portions of the control of the battery antenna having a secondary radiator are implemented in software, then the baseband subsystem 1810 also includes battery software 1855, which may cooperate with control logic that can be executed by the microprocessor 1802, or by another processor, to control the operation of the battery module 250.

The analog circuitry 1806 and the digital circuitry 1808 include the signal processing, signal conversion, and logic that convert an input signal provided by the I/O element 1816 to an information signal that is to be transmitted. Similarly, the analog circuitry 1806 and the digital circuitry 1808 include the signal processing, signal conversion, and logic that convert an input signal provided by the RF circuit 232 to an information signal that contains recovered information. The digital circuitry 1808 can include, for example, a digital signal processor (DSP), a field programmable gate array (FPGA), or any other processing device. Because the baseband subsystem 1810 includes both analog and digital elements, it can be referred to as a mixed signal device (MSD).

A battery module 250 supplies DC power to a battery circuit assembly 242 over connection 216. The battery circuit assembly 242 couples DC power to the baseband subsystem 1810 over connection 1844. The antenna matching assembly 244 is also coupled to the RF circuit 232 over a bidirectional connection 1846.

A signal received by the battery module 250 is provided over connection 216 to the antenna matching assembly 244 and to the RF circuit over connection 1846. A signal to be transmitted is provided by the RF circuit 232, over connection 1846 to the antenna matching assembly 244, and then to the battery module 250 over connection 216.

Figure 19A:
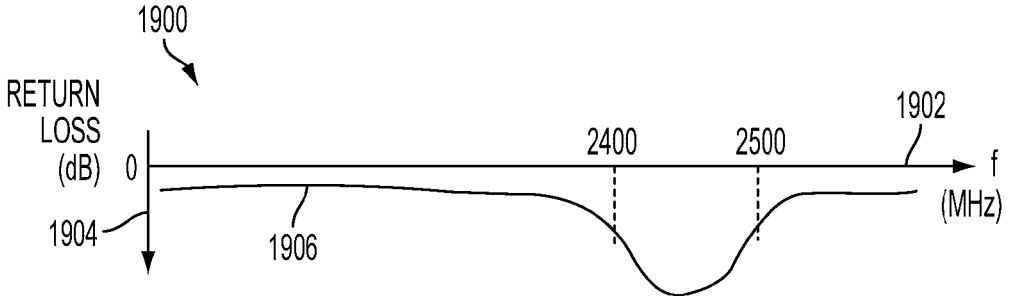
FIGS. 19A through 19D are graphical illustrations showing example effects of the secondary radiator on the radiated performance of the battery.

FIGS. 19A through 19D are graphical illustrations showing example effects of the secondary radiator on the radiated performance of the battery 202 when the battery positive contact 212 is used as an antenna. FIG. 19A is a diagram 1900 in which the horizontal axis 1902 represents frequency (f) in Megahertz (MHz), and the vertical axis 1904 represents the return loss (in dB) of an antenna comprising the positive contact 212 of the battery 202. In the example shown in FIG. 19A, the desired communication band is in the range of 2400-2500 MHz, used in devices communicating in what is referred to as the "Bluetooth" communication band. The trace 1906 represents the return loss of the positive contact 212 of the battery 202. As shown, there is a significant decrease in return loss between 2400 and 2500 MHz because that is the desired communication band within which the battery positive contact 212 used as an antenna is designed to operate.

Figure 19B:
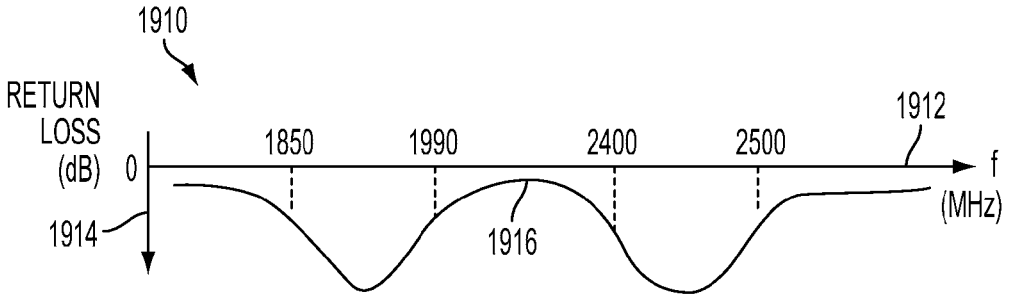

FIG. 19B is a diagram 1910 in which the horizontal axis 1912 represents frequency (f) in Megahertz (MHz), and the vertical axis 1914 represents the return loss (in dB) of an antenna comprising the positive contact 212 of the battery 202. In the example shown in FIG. 19B, a secondary radiator (e.g., the secondary radiator 215, or any secondary radiator described herein) is added to the battery module 250 as described above. In the embodiment illustrated in FIG. 19B, the secondary radiator 215 is designed to resonate at a frequency that is different than the frequency at which the positive contact 212 of the battery 202 is designed to resonate. The secondary radiator 215 can be designed using any of the example shapes and locations described herein, or indeed, other shapes and structures, to resonate at any desired frequency. Generally, the longer or larger the secondary radiator 215, the lower the resonant frequency. Conversely, the shorter or smaller the secondary radiator 215, the higher the resonant frequency.

In the example shown in FIG. 19B, the secondary radiator 215 is designed to resonate at frequencies ranging generally between 1850 and 1990 MHz, commonly referred to as the "personal communications service" (PCS) band. The trace 1916 illustrates a drop in return loss in both the frequency range between 1850 and 1990 MHz, and in the frequency range between 2400 and 2500 MHz. In this manner, a communication device having an antenna comprising the secondary radiator 215 in addition to the positive contact 212 of the battery 202 can operate within both the Bluetooth communication band and within the PCS communication band, a so-called "dual band" communication device.

Figure 19C:
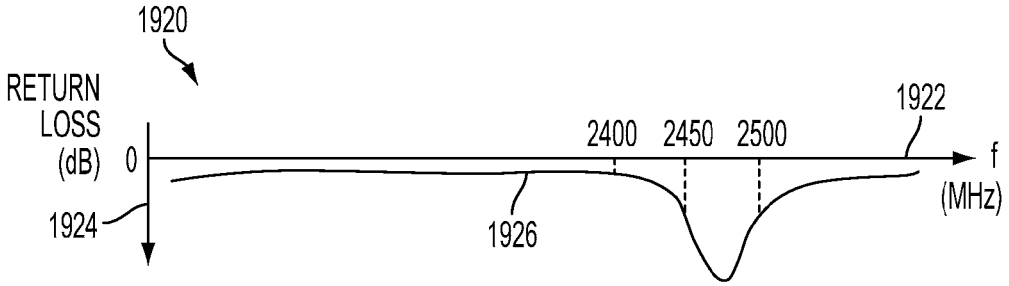

FIG. 19C is a diagram 1920 in which the horizontal axis 1922 represents frequency (f) in Megahertz (MHz), and the vertical axis 1924 represents the return loss (in dB) of an antenna comprising the positive contact 212 of the battery 202. In the example shown in FIG. 19C, it is assumed that the size of the battery 202 is such that an antenna comprising the positive contact 212 of the battery 202 cannot be designed to resonate within the entire frequency range of 2400 to 2500 MHz, but instead, can resonate between approximately 2450 and 2500 MHz, as shown by the trace 1926.

Figure 19D:
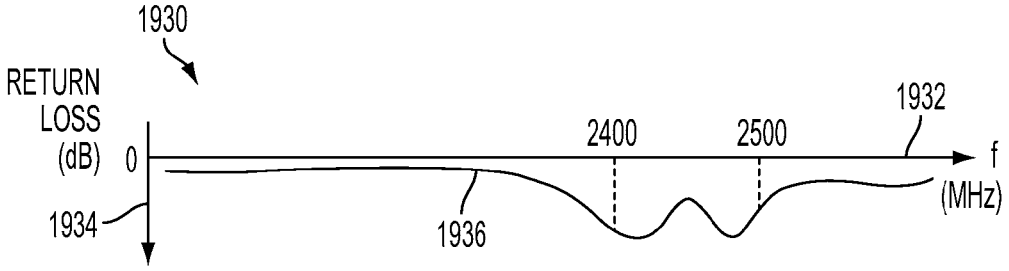

FIG. 19D is a diagram 1930 in which the horizontal axis 1932 represents frequency (f) in Megahertz (MHz), and the vertical axis 1934 represents the return loss (in dB) of an antenna comprising the positive contact 212 of the battery 202 of FIG. 19C. A secondary radiator 215 can be designed to resonate within a frequency range beginning at approximately 2400 MHz, as shown by trace 1936, thereby lowering the return loss beginning at approximately 2400 MHz. In such an implementation, the secondary radiator 215 can widen the bandwidth of an antenna comprising the positive contact 212 of the battery 202 (a first desired bandwidth ranging from 2450 to 2500 shown in FIG. 19C to a second desired bandwidth ranging from 2400 to 2500 shown in FIG. 19D), so that a communication device having a battery 202 smaller than the battery that produces the communication bandwidth of FIG. 19A can use both the positive contact 212 of the battery 202 as an antenna and the secondary radiator 215 to communicate using substantially all of the frequency range of 2400 to 2500 MHz.

Figure 20:
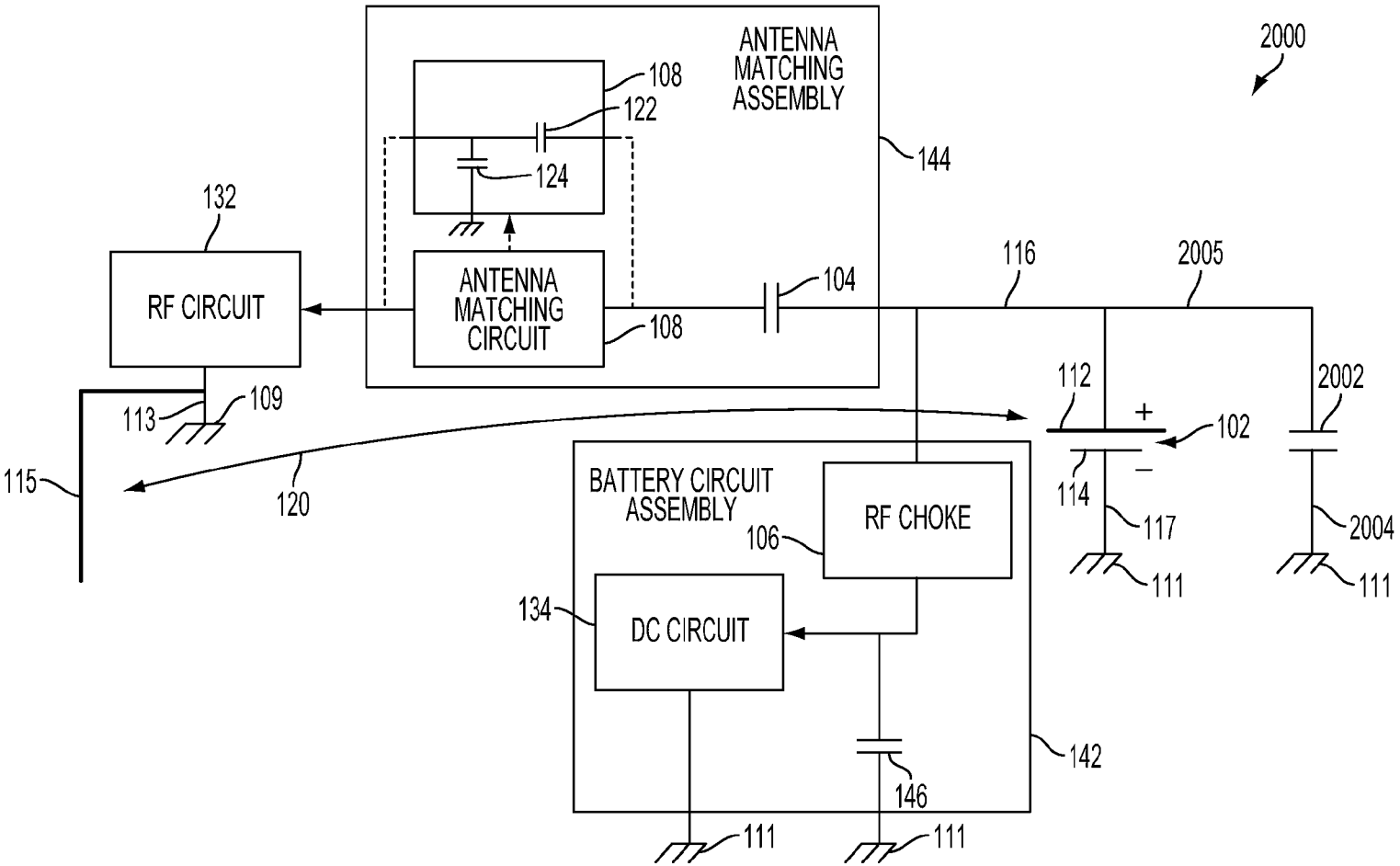
FIG. 20 shows a block diagram of an alternative embodiment of a circuit having a combination battery antenna with a secondary radiator.

FIG. 20 shows a block diagram of an alternative embodiment of a circuit having a combination battery antenna with a secondary radiator. The elements in FIG. 20 that correspond to the elements in FIG. 1 and FIG. 9 are identically labeled and will not be described again in detail. The embodiment of FIG. 20 comprises an additional metallic structure 2005 electrically coupling the positive contact 112 of the battery 102 to RF ground 111 (in the example where a single ground plane comprises both DC and RF ground) through an additional blocking capacitor 2002. In this embodiment, the additional blocking capacitor 2002 can have a relatively high value, such as, for example, 10 pF or higher, such that it appears as a short circuit at RF, but as an open circuit at DC. The additional metallic structure 2005 can comprise a metal or a metallic structure, similar to the structure of the secondary radiator described herein.

The additional metallic structure 2005 and the additional blocking capacitor 2002 allow the battery 102 to be located directly over a metallic ground plane of a CCA as will be described below. The additional blocking capacitor 2002 ensures that the positive contact 112 of the battery 102 does not short to ground 111.

Figure 21:
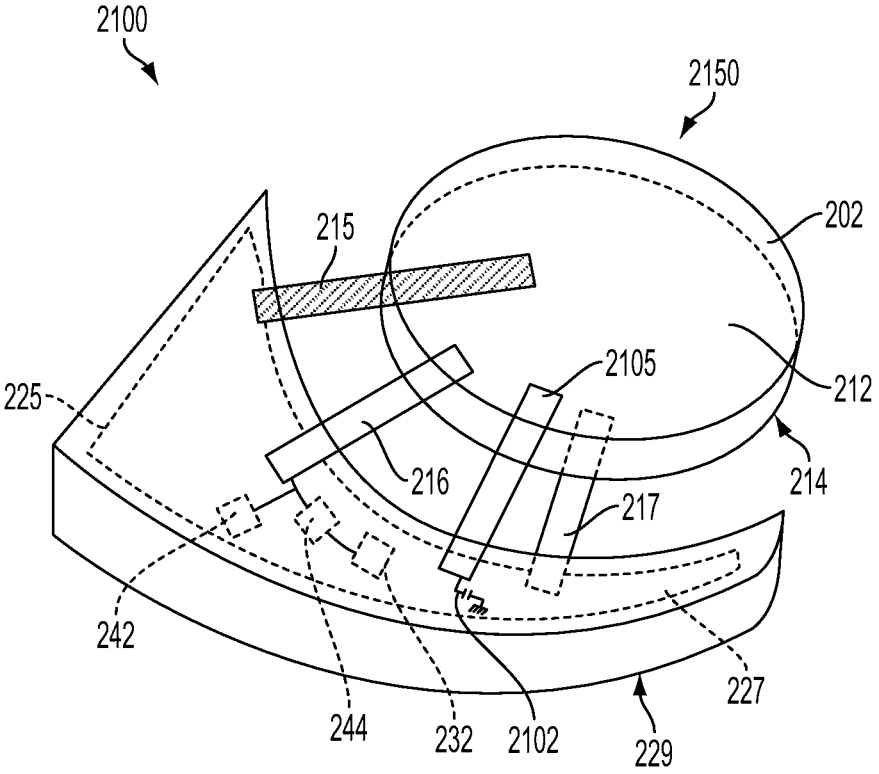
FIG. 21 is a perspective view of the embodiment of the circuit assembly having a battery antenna and a secondary radiator shown in FIG. 20.

FIG. 21 is a perspective view of the embodiment of the circuit assembly having a battery antenna and a secondary radiator shown in FIG. 20. The elements of FIG. 21 will be referred to using the nomenclature 21XX, where the XX denotes items in FIG. 21 that are similar to items labeled 20XX in FIG. 20, and using the nomenclature 2XX, where the XX denotes items in FIG. 21 that are similar to items labeled 2XX in FIG. 2. In the embodiment shown in FIG. 21, the battery module 2150 comprises additional metallic structure 2105 electrically coupling the positive contact 212 of the battery 202 to the RF ground portion of the ground plane 227 through an additional blocking capacitor 2102.

Figure 22:
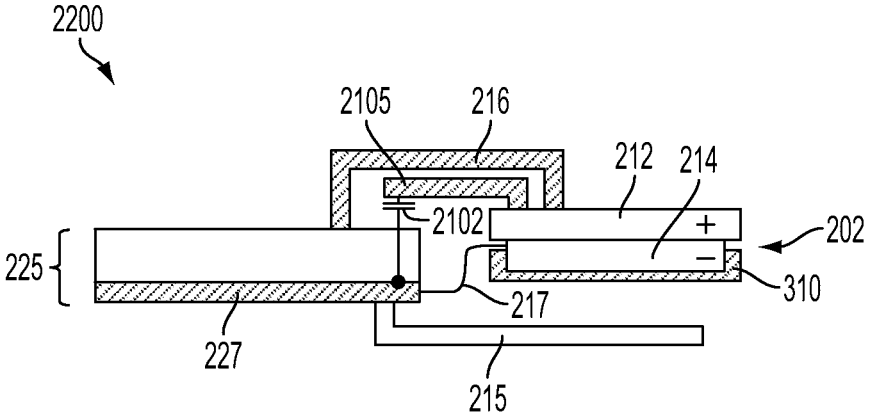
FIG. 22 is a cross-sectional view of the embodiment of the circuit assembly of FIG. 21.

FIG. 22 is a cross-sectional view of the embodiment of the circuit assembly of FIG. 21. In the embodiment shown in FIG. 22, the additional metallic structure 2105 electrically couples the positive contact 212 of the battery 202 to the RF ground portion of the ground plane 227 through an additional blocking capacitor 2102.

Figure 23:
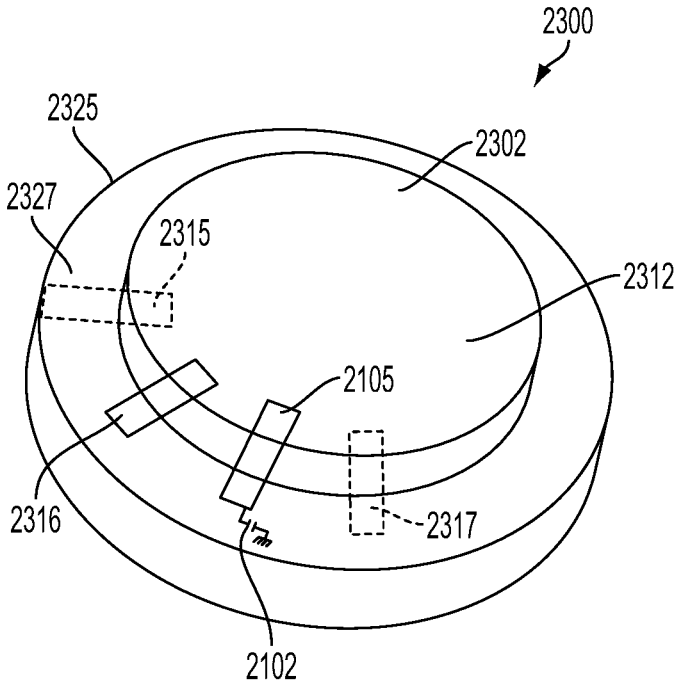
FIG. 23 is a perspective view of an embodiment of a combination battery antenna with a secondary radiator having an additional metallic structure.

FIG. 23 is a perspective view of an embodiment of a combination battery antenna with a secondary radiator having an additional metallic structure. In the embodiment shown in FIG. 23, the battery 2302 is located over a CCA 2325 having a ground plane 2327 that extends completely under the battery 2302. The additional metallic structure 2105 electrically couples the positive contact 2312 of the battery 2302 to the RF ground portion of the ground plane 2327 through the additional blocking capacitor 2102.

The additional blocking capacitor 2102 provides a matching mechanism that allows the embodiments shown in FIGS. 20 through 23 to work with or without the presence of the ground plane 2327 underneath the battery 2302. These embodiments also work with embodiments of the secondary radiator described herein. The additional metallic structure 2105 and the additional blocking capacitor 2102 shorts the antenna formed by the positive contact 2312 of the battery 2302 to the RF ground. This mechanism is manipulated by adjusting the distance between the additional metallic structure 2105 and the conductor 2316 that connects the positive contact 2312 of the battery 2302 to the matching circuit 244 (FIG. 21) on the CCA 225 (FIG. 21). The additional DC blocking capacitor 2102 is used to block the DC current from the positive contact 2312 to RF ground and to DC ground.

In view of the disclosure above, one of ordinary skill in programming is able to write computer code or identify appropriate hardware and/or circuits to implement the disclosed invention without difficulty based on the associated description in this specification, for example. Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the FIGS. which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention, as defined by the following claims.

What is claimed is:

1. A combination battery and antenna, comprising:

a battery having a positive contact and a negative contact, wherein only one of the positive contact and the negative contact comprises an antenna coupled to a matching circuit and to a battery circuit assembly comprising a radio frequency choke, and wherein the other one of the positive contact and the negative contact is electrically coupled to a ground plane, wherein the ground plane comprises a direct current (DC) ground and a radio frequency (RF) ground, whereby DC is supplied to the battery circuit assembly and an RF signal is supplied to an RF circuit; and at least one secondary radiator parasitically coupled to the at least one of the positive contact and the negative contact of the battery, and further electrically coupled to the ground plane, wherein the at least one secondary radiator is a metallic structure formed from a metallic material that is also used to form the ground plane, the secondary radiator being connected to the negative contact of the battery.

2. The combination battery and antenna of claim 1, wherein the at least one of the positive contact and the negative contact of the battery and the at least one secondary radiator operate as an antenna at a plurality of radio frequency bands.

3. The combination battery and antenna of claim 1, wherein the at least one of the positive contact and the negative contact of the battery and the at least one secondary radiator operate as an antenna within a radio frequency band, the at least one of the positive contact and the negative contact of the battery provides a first radio frequency band, and the at least one secondary radiator widens the first radio frequency band to a second radio frequency band.

4. The combination battery and antenna of claim 1, further comprising an antenna matching circuit connected to the at least one of the positive contact and the negative contact of the battery, the antenna matching circuit comprising any of a capacitive (C) and an inductive (L) structure configured to allow the at least one of the positive contact and the negative contact of the battery and the at least one secondary radiator to function as an antenna in a predetermined frequency range.

5. The combination battery and antenna of claim 4, wherein the predetermined frequency range is approximately 2.4 GHz to approximately 2.5 GHz.

6. A method of using a battery as an antenna, the method comprising:

providing a battery having a positive contact and a negative contact, wherein only one of the positive contact and the negative contact comprises an antenna coupled to a matching circuit and to a battery circuit assembly comprising a radio frequency choke, and wherein the other one of the positive contact and the negative contact is electrically coupled to a ground plane, wherein the ground plane comprises a direct current (DC) ground and a radio frequency (RF) ground;

supplying DC to the battery circuit assembly and an RF signal to an RF circuit;

parasitically coupling at least one secondary radiator to the at least one of the positive contact and the negative contact of the battery, wherein the at least one secondary radiator is a metallic structure formed from a metallic material that is also used to form the ground plane, the secondary radiator being connected to the negative contact of the battery; and electrically coupling the at least one secondary radiator to the ground plane.

7. The method of claim 6, further comprising operating the at least one of the positive contact and the negative contact of the battery and the at least one secondary radiator as an antenna at a plurality of radio frequency bands.

8. The method of claim 6, further comprising operating the at least one of the positive contact and the negative contact of the battery and the at least one secondary radiator as an antenna within a radio frequency band, the at least one of the positive contact and the negative contact of the battery providing a first radio frequency band, and the at least one secondary radiator widening the first radio frequency band to a second radio frequency band.

9. The method of claim 6, further comprising connecting an antenna matching circuit to the at least one of the positive contact and the negative contact of the battery, the antenna matching circuit comprising any of a capacitive (C) and an inductive (L) structure configured to allow the at least one of the positive contact and the negative contact of the battery and the at least one secondary radiator to function as an antenna in a predetermined frequency range.

10. The method of claim 9, wherein the predetermined frequency range is approximately 2.4 GHz to approximately 2.5 GHz.

11. A radio frequency (RF) communication device, comprising:

a baseband subsystem;

a transceiver operatively coupled to the baseband subsystem;

a battery having a positive contact and a negative contact, wherein only one of the positive contact and the negative contact comprises an antenna coupled to a matching circuit and to a battery circuit assembly comprising an RF choke, and wherein the other one of the positive contact and the negative contact is electrically coupled to a ground plane, wherein the ground plane comprises a direct current (DC) ground and an RF ground, whereby DC is supplied to the battery circuit assembly and an RF signal is supplied to an RF circuit; and at least one secondary radiator parasitically coupled to the at least one of the positive contact and the negative contact of the battery, and further electrically coupled to the ground plane, wherein the at least one secondary radiator is a metallic structure formed from a metallic material that is also used to form the ground plane, the secondary radiator being connected to the negative contact of the battery.

12. The communication device of claim 11, wherein the at least one of the positive contact and the negative contact of the battery and the at least one secondary radiator operate as an antenna at a plurality of radio frequency bands.

13. The communication device of claim 11, wherein the at least one of the positive contact and the negative contact of the battery and the at least one secondary radiator operate as an antenna within a radio frequency band, the at least one of the positive contact and the negative contact of the battery provides a first radio frequency band, and the at least one secondary radiator widens the first radio frequency band to a second radio frequency band.

14. The communication device of claim 11, further comprising an antenna matching circuit connected to the at least one of the positive contact and the negative contact of the battery, the antenna matching circuit comprising any of a capacitive (C) and an inductive (L) structure configured to allow the at least one of the positive contact and the negative contact of the battery and the at least one secondary radiator to function as an antenna in a predetermined frequency range.

15. The communication device of claim 14, wherein the predetermined frequency range is approximately 2.4 GHz to approximately 2.5 GHz.

16. A combination battery and antenna, comprising:

a circuit card assembly having a ground plane, wherein the ground plane comprises a direct current (DC) ground and a radio frequency (RF) ground;

a battery located over the circuit card assembly, the battery having a positive contact and a negative contact, wherein only one of the positive contact and the negative contact comprises an antenna coupled to a matching circuit and to a battery circuit assembly comprising a radio frequency choke, and wherein the other one of the positive contact and the negative contact is coupled to the DC ground, whereby DC is supplied to the battery circuit assembly and an RF signal is supplied to an RF circuit;

at least one secondary radiator parasitically coupled to the at least one of the positive contact and the negative contact of the battery, and further electrically coupled to the ground plane, wherein the at least one secondary radiator is a metallic structure formed from a metallic material that is also used to form the ground plane, the secondary radiator being connected to the negative contact of the battery;

a conductor electrically connecting the positive contact of the battery to circuitry located on the circuit card assembly; and an additional metallic structure and a blocking capacitor electrically connecting the positive contact of the battery to the ground plane.

17. The combination battery and antenna of claim 16, wherein the battery is located over at least a portion of the ground plane.

18. The combination battery and antenna of claim 1, wherein the positive contact is directly connected to the matching circuit and the radio frequency choke, and wherein the matching circuit and the radio frequency choke are electrically coupled to the ground plane.

19. The method of claim 6, wherein the positive contact is directly connected to the matching circuit and the radio frequency choke, and wherein the matching circuit and the radio frequency choke are electrically coupled to the ground plane.

* * * * *